US008960292B2

(12) United States Patent
Smith et al.

(10) Patent No.: US 8,960,292 B2
(45) Date of Patent: Feb. 24, 2015

(54) HIGH RATE STIMULATION METHOD FOR DEEP, LARGE BORE COMPLETIONS

(75) Inventors: Malcolm Smith, Indiana, PA (US); Loyd East, Jr., Tomball, TX (US); Milorad Stanojcic, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/358,079

(22) Filed: Jan. 22, 2009

(65) Prior Publication Data

US 2010/0044041 A1 Feb. 25, 2010

Related U.S. Application Data

(60) Provisional application No. 61/091,229, filed on Aug. 22, 2008.

(51) Int. Cl.

| | |
|---|---|
| ***E21B 43/26*** | (2006.01) |
| ***E21B 34/14*** | (2006.01) |
| ***E21B 43/114*** | (2006.01) |
| ***E21B 43/267*** | (2006.01) |

(52) U.S. Cl.

CPC ..... *E21B 43/26* (2013.01); *E21B 34/14* (2013.01); *E21B 43/114* (2013.01); *E21B 43/267* (2013.01)

USPC ..... 166/308.1; 166/328

(58) Field of Classification Search

USPC ..... 166/280.1, 328, 271, 308.1–308.6

See application file for complete search history.

(56) References Cited

U.S. PATENT DOCUMENTS 2,050,970 A 8/1936 Hughes
2,312,018 A * 2/1943 Beckman ..... 175/67

(Continued)

FOREIGN PATENT DOCUMENTS

CA 2734351 A1 2/2010
WO 03072907 A1 9/2003

(Continued)

OTHER PUBLICATIONS

Cipolla, C. L., et al., "The relationship between fracture complexity, reservoir properties, and fracture treatment design," SPE 115769, 2008, pp. 1-25, Society of Petroleum Engineers.

(Continued)

*Primary Examiner* — Shane Bomar
*Assistant Examiner* — Kipp Wallace
(74) *Attorney, Agent, or Firm* — John W. Wustenberg; Baker Botts L.L.P.

(57) ABSTRACT

A method of servicing a wellbore comprising inserting a first tubing member into the wellbore, wherein a manipulatable fracturing tool is coupled to the first tubing member and comprises one or more ports configured to alter a flow of fluid through the manipulatable fracturing tool, positioning the manipulatable fracturing tool proximate to a formation zone, manipulating the manipulatable fracturing tool to establish fluid communication between the flowbore of the first tubing member and the wellbore, introducing a first component of a composite fluid into the wellbore via the flowbore of the first tubing member, introducing a second component of the composite fluid into the wellbore via an annular space formed by the first tubing member and the wellbore, mixing the first component with the second component within the wellbore, and causing a fracture to form or be extended within the formation zone.

23 Claims, 14 Drawing Sheets

(56) References Cited

U.S. PATENT DOCUMENTS 2,703,316 A 3/1955 Schneider
2,753,940 A 7/1956 Bonner
3,912,692 A 10/1975 Casey et al.
4,005,750 A 2/1977 Shuck
4,312,406 A * 1/1982 McLaurin et al. ..... 166/386
4,387,769 A 6/1983 Erbstoesser et al.
4,509,598 A 4/1985 Earl et al.
4,515,214 A 5/1985 Fitch et al.
4,590,995 A 5/1986 Evans
4,687,061 A 8/1987 Uhri
4,869,322 A 9/1989 Vogt, Jr. et al.
4,887,670 A 12/1989 Lord et al.
4,949,788 A 8/1990 Szarka et al.
5,074,360 A 12/1991 Guinn
5,111,881 A 5/1992 Soliman et al.
5,145,004 A 9/1992 Cornette
5,216,050 A 6/1993 Sinclair
5,241,475 A 8/1993 Lee et al.
5,318,123 A 6/1994 Venditto et al.
5,482,116 A 1/1996 El-Rabaa et al.
5,494,103 A 2/1996 Surjaatmadja et al.
5,499,678 A 3/1996 Surjaatmadja et al.
5,533,571 A 7/1996 Surjaatmadja et al.
5,547,023 A 8/1996 McDaniel et al.
5,595,245 A 1/1997 Scott, III
5,765,642 A * 6/1998 Surjaatmadja ..... 166/297
6,047,773 A 4/2000 Zeltmann et al.
6,283,210 B1 9/2001 Soliman et al.
6,323,307 B1 11/2001 Bigg et al.
6,394,184 B2 5/2002 Tolman et al.
6,401,815 B1 6/2002 Surjaatmadja et al.
6,439,310 B1 8/2002 Scott, III et al.
6,474,419 B2 11/2002 Maier et al.
6,543,538 B2 4/2003 Tolman et al.
6,565,129 B2 5/2003 Surjaatmadja
6,662,874 B2 12/2003 Surjaatmadja et al.
6,719,054 B2 4/2004 Cheng et al.
6,725,933 B2 4/2004 Middaugh et al.
6,779,607 B2 8/2004 Middaugh et al.
6,805,199 B2 10/2004 Surjaatmadja
6,837,523 B2 1/2005 Surjaatmadja et al.
6,938,690 B2 9/2005 Surjaatmadja
7,032,671 B2 4/2006 Aud
7,044,220 B2 5/2006 Nguyen et al.
7,059,407 B2 6/2006 Tolman et al.
7,066,265 B2 * 6/2006 Surjaatmadja ..... 166/308.1
7,090,153 B2 8/2006 King et al.
7,096,954 B2 * 8/2006 Weng et al. ..... 166/308.1
7,100,688 B2 9/2006 Stephenson et al.
7,108,064 B2 9/2006 Hart et al.
7,108,067 B2 * 9/2006 Themig et al. ..... 166/317
7,150,327 B2 12/2006 Surjaatmadja
7,152,677 B2 12/2006 Parlar et al.
7,159,660 B2 1/2007 Justus
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,273,099 B2 9/2007 East, Jr. et al.
7,273,313 B2 9/2007 Surjaatmadja
7,281,581 B2 10/2007 Nguyen et al.
7,287,592 B2 10/2007 Surjaatmadja et al.
7,296,625 B2 11/2007 East, Jr.
7,318,473 B2 1/2008 East, Jr. et al.
7,325,608 B2 2/2008 van Batenburg et al.
7,337,844 B2 3/2008 Surjaatmadja et al.
7,343,975 B2 3/2008 Surjaatmadja et al.
7,370,701 B2 5/2008 Surjaatmadja et al.
7,387,165 B2 * 6/2008 Lopez de Cardenas et al. ..... 166/313
7,398,825 B2 7/2008 Nguyen et al.
7,429,332 B2 9/2008 Surjaatmadja et al.
7,431,090 B2 10/2008 Surjaatmadja et al.
7,445,045 B2 11/2008 East, Jr. et al.
7,472,746 B2 1/2009 Maier
7,478,020 B2 1/2009 Guo et al.
7,478,676 B2 1/2009 East, Jr. et al.
7,506,689 B2 3/2009 Surjaatmadja et al.
7,520,327 B2 4/2009 Surjaatmadja
7,543,635 B2 6/2009 East et al.
7,571,766 B2 8/2009 Pauls et al.
7,571,767 B2 8/2009 Parker et al.
7,575,062 B2 8/2009 East, Jr.
7,580,796 B2 8/2009 Soliman et al.
7,595,281 B2 9/2009 McDaniel et al.
7,610,959 B2 11/2009 Surjaatmadja
7,617,871 B2 11/2009 Surjaatmadja et al.
7,625,846 B2 12/2009 Cooke, Jr.
7,647,964 B2 1/2010 Akbar et al.
7,673,673 B2 3/2010 Surjaatmadja et al.
7,690,427 B2 4/2010 Rispler
7,711,487 B2 5/2010 Surjaatmadja
7,723,264 B2 5/2010 McDaniel et al.
7,726,403 B2 6/2010 Surjaatmadja
7,730,951 B2 6/2010 Surjaatmadja et al.
7,740,072 B2 6/2010 Surjaatmadja
7,766,083 B2 8/2010 Willett et al.
7,775,278 B2 8/2010 Willberg et al.
7,841,396 B2 11/2010 Surjaatmadja
7,849,924 B2 12/2010 Surjaatmadja et al.
7,874,365 B2 1/2011 East, Jr. et al.
7,882,894 B2 2/2011 Nguyen et al.
7,931,082 B2 4/2011 Surjaatmadja
7,946,340 B2 5/2011 Surjaatmadja et al.
7,963,331 B2 6/2011 Surjaatmadja et al.
8,016,032 B2 9/2011 Mandrell et al.
8,056,638 B2 11/2011 Clayton et al.
8,061,426 B2 11/2011 Surjaatmadja
8,066,068 B2 11/2011 Lesko et al.
8,074,715 B2 12/2011 Rispler et al.
8,096,358 B2 1/2012 Rispler et al.
8,104,535 B2 1/2012 Sierra et al.
8,104,539 B2 1/2012 Stanojcic et al.
8,210,257 B2 7/2012 Dusterhoft et al.
8,267,172 B2 9/2012 Surjaatmadja et al.
8,307,893 B2 11/2012 Sierra et al.
8,307,904 B2 11/2012 Surjaatmadja
8,439,116 B2 5/2013 East, Jr. et al.
8,733,444 B2 5/2014 East, Jr. et al.
2005/0125209 A1 6/2005 Soliman et al.
2005/0230107 A1 * 10/2005 McDaniel et al. ..... 166/249
2006/0070740 A1 4/2006 Surjaatmadja et al.
2006/0086507 A1 4/2006 Surjaatmadja et al.
2006/0102344 A1 * 5/2006 Surjaatmadja et al. .... 166/250.1
2006/0118301 A1 6/2006 East, Jr. et al.
2006/0124312 A1 * 6/2006 Rytlewski et al. ..... 166/313
2006/0196667 A1 * 9/2006 Alba et al. ..... 166/308.1
2007/0029086 A1 2/2007 East, Jr.
2007/0051507 A1 * 3/2007 Ross et al. ..... 166/51
2007/0102156 A1 5/2007 Nguyen et al.
2007/0261851 A1 11/2007 Surjaatmadja
2007/0284106 A1 * 12/2007 Kalman et al. ..... 166/298
2007/0295506 A1 12/2007 Li et al.
2008/0000637 A1 1/2008 McDaniel et al.
2008/0060810 A9 3/2008 Nguyen et al.
2008/0135248 A1 * 6/2008 Talley et al. ..... 166/285
2008/0210429 A1 9/2008 McMillin et al.
2008/0217021 A1 9/2008 Lembcke et al.
2008/0302538 A1 * 12/2008 Hofman ..... 166/373
2009/0014168 A1 * 1/2009 Tips et al. ..... 166/73
2009/0044944 A1 * 2/2009 Murray et al. ..... 166/308.1
2009/0056934 A1 * 3/2009 Xu ..... 166/244.1
2009/0062157 A1 3/2009 Munoz, Jr. et al.
2009/0118083 A1 * 5/2009 Kaminsky et al. ..... 477/5
2009/0125280 A1 5/2009 Soliman et al.
2009/0139728 A1 6/2009 Schrader et al.
2009/0288833 A1 11/2009 Graham et al.
2009/0308588 A1 * 12/2009 Howell et al. ..... 166/66.4
2010/0243253 A1 9/2010 Surjaatmadja et al.
2011/0028358 A1 2/2011 Welton et al.
2011/0284214 A1 11/2011 Ayoub et al.

(56) References Cited

U.S. PATENT DOCUMENTS

| | | | |
|---|---|---|---|
| 2012/0118568 | A1 | 5/2012 | Kleefisch et al. |
| 2012/0152550 | A1 | 6/2012 | East, Jr. |

FOREIGN PATENT DOCUMENTS

| | | | |
|---|---|---|---|
| WO | 2008027982 | A2 | 3/2008 |
| WO | 2008139132 | A1 | 11/2008 |
| WO | 2010020747 | A2 | 2/2010 |
| WO | 2010020747 | A3 | 2/2010 |
| WO | 2011010113 | A2 | 1/2011 |
| WO | 2011010113 | A3 | 1/2011 |

OTHER PUBLICATIONS

Soliman, M. Y., et al., "Geomechanics aspects of multiple fracturing of horizontal and vertical wells," SPE 86992, Sep. 2008, pp. 217-228, Society of Petroleum Engineers.
Waters, George, et al., "Simultaneous hydraulic fracturing of adjacent horizontal wells in the woodford shale," SPE 119635, 2008, pp. 1-22, Society of Petroleum Engineers.
Norris, M. R., et al., "Multiple proppant fracturing of horizontal wellbores in a chalk formation: evolving the process in the Valhall Field," SPE 50608, 1998, pp. 335-349, Society of Petroleum Engineers, Inc.
Halliburton brochure entitled "Delta Stim(TM) sleeve," Mar. 2007, 2 pages, Halliburton.
Halliburton brochure entitled "EquiFlow(TM) inflow control devices," Jan. 2008, 2 pages, Halliburton.
Patent application entitled "Apparatus and method for inflow control," by Alan B. Webb, et al., filed Jul. 1, 2008 as U.S. Appl. No. 12/166,257.
Patent application entitled "Apparatus and Method for Servicing a Wellbore," by Jim B. Surjaatmadja, et al., filed Nov. 19, 2008 as U.S. Appl. No. 12/274,193.
Provisional patent application entitled "High rate stimulation method for deep, large bore completions," by Malcolm Joseph Smith, et al., filed Aug. 22, 2008 as U.S. Appl. No. 61/091,229.
Baski brochure entitled, "Packers: general information," http://www.baski.com/packer.htm, Dec. 16, 2009, 4 pages, Baski, Inc.
Halliburton brochure entitled "Cobra Frac® service," Oct. 2004, 2 pages, Halliburton.
Halliburton brochure entitled "Cobra Frac® H service," Mar. 2009, 2 pages, Halliburton.
Halliburton brochure entitled "Cobra Frac® H service," Sep. 2009, 2 pages, Halliburton.
Halliburton brochure entitled, "RDT™—Oval pad and straddle packer," Feb. 2008, 2 pages. Halliburton.
Halliburton brochure entitled, "Swellpacker™ Cable System," 2009, 2 pages, Halliburton.
Halliburton HT-400 pump maintenance and repair manual, Jun. 1997, pp. 1-14, 1-15, 5-12 to 5-15, and 7-106 to 7-109, Halliburton.
Kundert, Donald, et al., "Proper evaluation of shale gas reservoirs leads to a more effective hydraulic-fracture stimulation," SPE 123586, 2009, pp. 1-11, Society of Petroleum Engineers.
Mullen, Mike, et al., A composite determination of mechanical rock properties for stimulation design (what to do when you don't have a sonic log), SPE 108139, 2007, pp. 1-13, Society of Petroleum Engineers.
Patent application entitled "Method for inducing fracture complexity in hydraulically fractured horizontal well completions," by Loyd E. East, Jr., et al., filed Sep. 24, 2009 as U.S. Appl. No. 12/566,467.
Patent application entitled "Complex fracturing using a straddle packer in a horizontal wellbore," by Loyd E. East, Jr., filed Jan. 12, 2010 as U.S. Appl. No. 12/686,116.
Provisional patent application entitled "Method for inducing fracture complexity in hydraulically fractured horizontal well completions," by Loyd E. East, Jr., et al., filed Jul. 24, 2009 as U.S. Appl. No. 61/228,494.
Provisional patent application entitled "Method for inducing fracture complexity in hydraulically fractured horizontal well completions," by Loyd E. East, Jr., et al., filed Sep. 17, 2009 as U.S. Appl. No. 61/243,453.
Ramurthy, Muthukumarappan, et al., "Effects of high-pressure-dependent leakoff and high-process-zone stress in coal stimulation treatments," SPE 107971, 2007, pp. 1-8, Society of Petroleum Engineers.
Rickman, Rick, et al., "A practical use of shale petrophysics for stimulation design optimization: all shale plays are not clones of the Barnett Shale," SPE 115258, 2008, pp. 1-11, Society of Petroleum Engineers.
Sneddon, I. N., "The distribution of stress in the neighbourhood of a crack in an elastic solid," Proceedings of the Royal Society of London; Series A, Mathematical and Physical Sciences, Oct. 22, 1946, pp. 229-260, vol. 187, No. 1009, The Royal Society.
Sneddon, I. N., et al., "The opening of a Griffith crack under internal pressure," 1946, p. 262-267, vol. 4, No. 3, Quarterly of Applied Mathematics.
Soliman, M. Y., et al., "Effect of friction and leak-off on fracture parameters calculated from hydraulic impedance testing," SPE 39529, 1998, pp. 245-251, Society of Petroleum Engineers, Inc.
Soliman, M. Y., et al., "GeoMechanics aspects of multiple fracturing of horizontal and vertical wells," SPE 86992, 2004, pp. 1-15, Society of Petroleum Engineers Inc.
Foreign communication from a related counterpart application—International Search Report and Written Opinion, PCT/GB2009/001904, Apr. 13, 2011, 10 pages.
Office Action dated Sep. 28, 2011 (27 pages), U.S. Appl. No. 12/566,467, filed Sep. 24, 2009.
Filing receipt and specification for patent application entitled "Method for Inducing Fracture Complexity in Hydraulically Fractured Horizontal Well Completions," by Loyd E East, Jr., et al., filed May 13, 2013 as U.S. Appl. No. 13/892,710.
Advances in Polymer Science, Author Index vols. 101-157 and Subject Index, 2002, 17 pages, Springer-Verlag Berlin Heidelberg.
Advances in Polymer Science, vol. 157, "Degradable Aliphatic Polyesters," 2002, 10 pages of Content and Publishing Information, Springer-Verlag Berlin Heidelberg.
Albertsson, Ann-Christine, et al., "Aliphatic Polyesters: Synthesis, Properties and Applications," Chapter 1 of Advances in Polymer Science, 2002, pp. 1-40, vol. 157, Springer-Verlag Berlin Heidelberg.
Edlund, U., et al., "Degradable Polymer Microspheres for Controlled Drug Delivery," Chapter 3 of Advances in Polymer Science, 2002, pp. 67-112, vol. 157, Springer-Verlag Berlin Heidelberg.
Hakkarainen, Minna, "Aliphatic Polyesters: Abiotic and Biotic Degradation and Degradation Products," Chapter 4 of Advances in Polymer Science, 2002, pp. 113-138, vol. 157, Springer-Verlag Berlin Heidelberg.
Halliburton brochure entitled "CobraMax® DM Service," Jul. 2011, 2 pages, Halliburton.
Lindsay, S. et al., "Downhole Mixing Fracturing Method Using Coiled Tubing Efficiently: Executed in the Eagle Ford Shale," SPE 153312, 2012, pp. 1-14, Society of Petroleum Engineers.
Lindblad, Margaretha Söderqvist, et al., "Polymers from Renewable Resources" Chapter 5 of Advances in Polymer Science, 2002, pp. 139-161, vol. 157, Springer-Verlag Berlin Heidelberg.
Office Action dated Dec. 6, 2012 (24 pages), U.S. Appl. No. 12/566,467, filed Sep. 24, 2009.
Office Action (Final) dated Oct. 29, 2012 (17 pages), U.S. Appl. No. 12/686,116, filed Jan. 12, 2010.
Advisory Action dated Jan. 2, 2013 (4 pages), U.S. Appl. No. 12/686,116, filed Jan. 12, 2010.
Filing receipt and patent application entitled "Method and Wellbore Servicing Apparatus for Production Completion of an Oil and Gas Well," by Jim B. Surjaatmadja, et al., filed Aug. 6, 2012 as U.S. Appl. No. 13/567,953.
Filing receipt and patent application entitled "Multi-Interval Wellbore Treatment Method," by Loyd Eddie East, et al., filed Apr. 9, 2012 as U.S. Appl. No. 13/442,441.

(56) References Cited

OTHER PUBLICATIONS

Stridsberg, Kajsa M., et al., "Controlled Ring-Opening Polymerization: Polymers with designed Macromolecular Architecture," Chapter 2 of Advances in Polymer Science, 2002, pp. 41-65, vol. 157, Springer-Verlag Berlin Heidelberg.
Warpinski, N.R., et al., "Mapping hydraulic fracture growth and geometry using microseismic events detected by a wireline retrievable accelerometer array," SPE 40014, 1998, pp. 335-346, Society of Petroleum Engineers.
Foreign communication from a related counterpart application—International Preliminary Report on Patentability, PCT/GB2009/001904, Apr. 19, 2011, 7 pages.
Foreign communication from a related counterpart application—International Search Report and Written Opinion, PCT/GB2010/001407, Mar. 23, 2011, 10 pages.
Office Action dated Jan. 26, 2012 (22 pages), U.S. Appl. No. 12/566,467, filed Sep. 24, 2009.
Patent application entitled "Method of Inducing Fracture Complexity in Hydraulically Fractured Horizontal Well Completions," by Loyd Eddie East, Jr., filed Feb. 23, 2012 as U.S. Appl. No. 13/403,423.
Advisory Action dated Mar. 30, 2012 (3 pages), U.S. Appl. No. 12/566,467, filed Sep. 24, 2009.
Foreign communication from a related counterpart application—International Search Report and Written Opinion, PCT/US2013/030784, May 9, 2014, 9 pages.
Office Action dated May 16, 2014 (54 pages), U.S. Appl. No. 13/442,411, filed Apr. 9, 2012.
Filing receipt and specification for patent application entitled "Wellbore Servicing Fluids and Methods of Making and Using Same," by Neil Joseph Modeland, filed Jan. 30, 2013 as U.S. Appl. No. 13/754,397.
Office Action dated May 16, 2013 (26 pages), U.S. Appl. No. 12/686,116, filed Jan. 12, 2010.
Foreign communication from a related counterpart application—Canadian Office Action, CA 2,734,351, Jun. 19, 2012, 2 pages.
Office Action dated Nov. 20, 2013 (31 pages), U.S. Appl. No. 13/892,710, filed May 13, 2013.
Foreign communication from a related counterpart application—International Preliminary Report on Patentability, PCT/GB2010/001407, Jan. 24, 2012, 8 pages.
Office Action dated May 23, 2012 (43 pages), U.S. Appl. No. 12/686,116, filed Jan. 12, 2010.
Filing receipt and specification for patent application entitled "Complex Fracturing Using a Straddle Packer in a Horizontal Wellbore," by Loyd E East, Jr., filed Dec. 13, 2013 as U.S. Appl. No. 14/106,323.
Office Action dated Sep. 29, 2014 (39 pages), U.S. Appl. No. 14/106,323, filed Dec. 13, 2013.
Notice of Allowance dated Jul. 31, 2014 (15 pages), U.S. Appl. No. 13/442,411, filed Apr. 9, 2012.
Office Action dated Oct. 9, 2014 (50 pages), U.S. Appl. No. 13/567,953, filed Aug. 6, 2012.
Office Action dated Oct. 16, 2014 (68 pages), U.S. Appl. No. 13/403,423, filed Feb. 23, 2012.

* cited by examiner

HIGH RATE STIMULATION METHOD FOR DEEP, LARGE BORE COMPLETIONS

CROSS-REFERENCE TO RELATED APPLICATIONS

The present application claims priority to U.S. Provisional Patent Application Ser. No. 61/091,229 filed Aug. 22, 2008 by Malcolm Joseph Smith, et al. and entitled "High Rate Stimulation Method for Deep, Large Bore Completions," which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a fracturing fluid may be introduced into a portion of a subterranean formation penetrated by a wellbore at a hydraulic pressure sufficient to create or enhance at least one fracture therein. Stimulating or treating the wellbore in such ways increases hydrocarbon production from the well. The fracturing equipment may be included in a completion assembly used in the overall production process. Alternatively the fracturing equipment may be removably placed in the wellbore during and/or after completion operations.

In some wells, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be drained/produced into the wellbore. When stimulating a formation from a wellbore, or completing the wellbore, especially those wellbores that are highly deviated or horizontal, it may be advantageous to create multiple pay zones. Such multiple pay zones may be achieved by utilizing a variety of tools comprising a movable fracturing tool with perforating and fracturing capabilities, or with actuatable sleeve assemblies, also referred to as sleeves or casing windows, disposed in a downhole tubular.

A typical formation stimulation process might involve hydraulic fracturing of the formation and placement of a proppant in those fractures. Typically, the fracturing fluid and proppant are mixed in containers at the surface of the well site. After the fracturing fluid is mixed, it is pumped down the wellbore where the fluid passes into the formation and induces a fracture in the formation, i.e., fracture initiation. A successful formation stimulation procedure will increase the movement of hydrocarbons from the fractured formation into the wellbore by creating and/or increasing flowpaths into the wellbore.

Conventional formation stimulation procedures are capital intensive. Difficulties often arise in attempting to implement known methods of formation stimulation, for example, relatively high pressures are required to pump the viscous, surface-mixed compositions down the wellbore and into the formation. These pumping requirements necessitate great horsepower and specialized high-rate blending equipment while resulting in excessive wear on pumping equipment. Thus, conventional formation stimulation operations are commonly associated with great cost.

Further, the abrasive and viscous characteristics of fracturing fluid limit the rate at which a fracturing fluid may be pumped downhole. Friction from the high-rate pumping of an abrasive and viscous fracturing fluid may cause downhole wellbore equipment failure, wear, or degradation. Thus, in conventional formation stimulation operations, the rate at which fracturing fluids were pumped to a downhole formation could not be increased beyond the point at which the velocity of the fracturing fluid might result in damage to wellbore equipment. Because an operator would be limited as to the rate at which a fracturing fluid might be pumped downhole, the time necessitated by fracturing operations was greater than it might have been if higher velocity pumping rates were achievable.

Treating pressures may fluctuate, often increase, during the formation stimulation process, whereupon the operator must prematurely terminate the treatment or risk serious problems such as ruptures of surface equipment, wellbore casing, and tubulars. Treating pressures beyond the acceptable range may occur during the formation stimulation process in the event of a premature screenout. Such a screenout occurs where the rate of stimulation fluid leak-off into the formation exceeds the rate at which fluid is being pumped down the wellbore, resulting in the proppant compacting within the fracture. The problems associated with a premature screenout are discussed in U.S. Pat. No. 5,595,245., which is incorporated herein by reference.

Where a premature screenout is detected during a formation stimulation operation, the operator may attempt to alter the density, quantity, or concentration of the proppant laden fluid in an effort to prevent the occurrence of such screenout. However, in conventional formation stimulation operations, alterations to the composition of the fluid made at the surface will not be realized downhole for a significant period of time; thus, such alterations to the composition of the fluid may not be effective in avoiding a screenout.

Further, the volume of fracturing fluid necessitated in a conventional fracturing operation can be very high, thus increasing the substantial costs associated with such processes. In a conventional formation stimulation process, the fracturing fluid is mixed at the surface and pumped down the wellbore, eventually reaching the formation. Thus, the entire flowpath between the surface mixing chamber and the formation must be filled with the fracturing fluid. In deep wellbore embodiments, for example, a wellbore 12,000 feet or more in depth, this means that the entire column must be filled and maintained with fracturing fluid throughout the fracturing operation. The high cost of fracturing fluids paired with the necessary volume of fracturing fluid underscores the capital intensive nature of conventional formation stimulation processes.

Presently, another challenge in treating deep, high volume wellbores is dealing with the volume of fluid required to flush these treatments. A conventional approach would be to run smaller tubulars (e.g., coiled tubing or jointed pipe) into the well, isolating the larger strings (e.g., casing) from the treatment. While this eliminates the need for large pre-flush and flush volumes, it can also pose a significant cost to the customer. With current pinpoint technology, the only way to eliminate the large annular flush volumes is to pump proppant laden fluid down the coiled tubing/jointed pipe. In some processes, a hydrajetting tool on the end of the coiled tubing/jointed pipe remains as the only exit point for the slurry. This limits both the rate, due to friction, and the total mass of proppant which can be pumped due to jet erosion. Thus, a need exists for a wellbore servicing method and apparatus which will allow for high pumping rates while providing the operator with real-time control of the character of a formation stimulation fluid. It is further desirable that such a method and apparatus might have the effect of lessening the amount of capital currently associated with formation stimulation procedures.

SUMMARY

Disclosed herein is a method of servicing a wellbore comprising inserting a first tubing member having a flowbore into the wellbore, wherein a manipulatable fracturing tool, or a component thereof, is coupled to the first tubing member and wherein the manipulatable fracturing tool comprises one or more ports configured to alter a flow of fluid through the manipulatable fracturing tool, positioning the manipulatable fracturing tool proximate to a formation zone to be fractured, manipulating the manipulatable fracturing tool to establish fluid communication between the flowbore of the first tubing member and the wellbore, introducing a first component of a composite fluid into the wellbore via the flowbore of the first tubing member, introducing a second component of the composite fluid into the wellbore via an annular space formed by the first tubing member and the wellbore, mixing the first component of the composite fluid with the second component of the composite fluid within the wellbore, and causing a fracture to form or be extended within the formation zone.

Also disclosed herein is a wellbore servicing apparatus comprising a manipulatable fracturing tool comprising at least one axial flowpath, at least a first and a second actuatable ports, wherein the tool is configurable to provide a fluid flow through the first actuatable port into the surrounding wellbore to degrade a liner, a casing, a formation zone, or combinations thereof, and wherein the tool is configurable to provide a fluid flow through the second actuatable port into the surrounding wellbore to propagate fractures in the formation zone.

Further disclosed herein is a method of servicing a wellbore comprising inserting a casing having a flowbore into the wellbore, wherein a plurality of manipulatable fracturing tools are coupled to the casing and wherein the manipulatable fracturing tools comprise one or more ports configured to alter a flow of fluid through the manipulatable fracturing tool, positioning the manipulatable fracturing tools proximate to zones in a formation to be fractured, inserting a first tubing member within the casing, wherein a shifting tool is attached to the first tubing member, positioning the shifting tool proximate to at least one of the manipulatable fracturing tools, actuating the shifting tool such that the actuation of the shifting tool engages and manipulates the manipulatable fracturing tool to establish fluid communication between the flowbore of the first tubing member and the wellbore, introducing a first component of a composite fluid into the wellbore via the flowbore of the first tubing member and the one or more ports, introducing a second component of the composite fluid into the wellbore via an annular space formed by the first tubing member and the casing, mixing the first component of the composite fluid with the second component of the composite fluid within the wellbore, and causing a fracture to form or be extended within the formation.

DETAILED DESCRIPTION OF THE EMBODIMENTS

Figure 1:
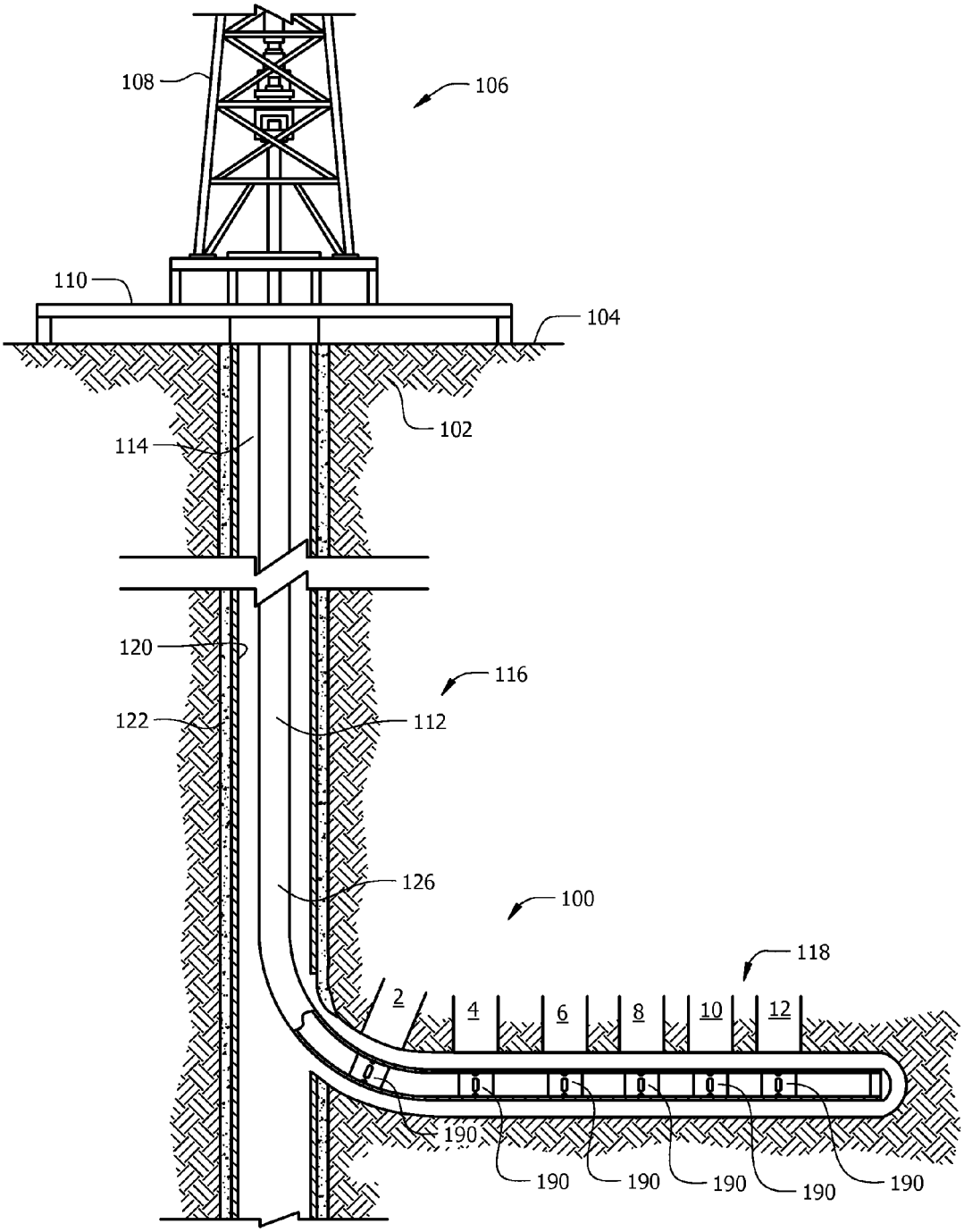
FIG. 1 is a simplified cutaway view of a wellbore servicing apparatus comprising multiple manipulatable fracturing tools in an operating environment.

In the drawings and descriptions that follow, like parts are typically marked throughout the specification and drawings with the same reference numerals, respectively. The drawn figures are not necessarily to scale. Certain features of the invention may be shown exaggerated in scale or in somewhat schematic form and some details of conventional elements may not be shown in the interest of clarity and conciseness. The present invention may be implemented in embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ." Reference to up or down will be made for purposes of description with "up," "upper," "upward" or "upstream" meaning toward the surface of the wellbore and with "down," "lower," "downward," "downhole," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The term "seat" as used herein may be referred to as a ball seat, but it is understood that seat may also refer to any type of catching or stopping device for an obturating member or other member sent through a work string fluid passage that comes to rest against a restriction in the passage. The various characteristics mentioned above, as well as other features and characteristics described in more detail below, will be readily apparent to those skilled in the art with the aid of this disclosure upon reading the following detailed description of the embodiments, and by referring to the accompanying drawings.

The methods, systems, and apparatuses disclosed herein include embodiments wherein two or more component fluids of a composite wellbore servicing fluid are independently pumped downhole and mixed in a portion of the wellbore proximate to a given formation zone. The component fluids may be selectively emitted into the wellbore via the operation of a wellbore servicing apparatus which comprises one or more manipulatable fracturing tools. The manipulatable fracturing tool(s) may be independently configurable as to the way in which fluid is emitted therefrom. By positioning a manipulatable fracturing tool proximate to a given formation zone, the communication of fluids may thus be established with the proximate formation zone, dependent upon how the manipulatable fracturing tool is configured. The manipulatable fracturing tool may be manipulated or actuated via a variety of means. Once the manipulatable fracturing tool is configured to perform a given wellbore servicing operation, component fluids may be provided via multiple and/or independent flowpaths and mixed to form a composite fluid in situ in the wellbore proximate to the formation zone. Such a composite fluid might be used, for example, in perforating, hydrajetting, acidizing, isolating, flushing, or fracturing operations.

FIG. 1 depicts an exemplary operating environment of an embodiment of the methods, systems, and apparatuses disclosed herein. It is noted that although some of the figures may exemplify horizontal or vertical wellbores, the principles of the foregoing process, methods, and systems are equally applicable to horizontal and vertical conventional wellbore configurations. The horizontal or vertical nature of any figure is not to be construed as limiting the wellbore to any particular configuration. While a wellbore servicing apparatus 100 is shown and described with specificity, various other wellbore servicing apparatus 100 embodiments consistent with the teachings herein are described infra. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. In an embodiment, the drilling rig 106 comprises a derrick 108 with a rig floor 110 through which a work string 112 extends downward from the drilling rig 106 into the wellbore 114. In an embodiment, the work string 112 delivers the wellbore servicing apparatus 100 or some part thereof to a predetermined depth within the wellbore 114 to perform an operation such as perforating a casing and/or formation, expanding a fluid path therethrough, fracturing the formation 102, producing hydrocarbons from the formation 102, or other completion servicing operation. The drilling rig 106 may be conventional and may comprise a motor driven winch and other associated equipment for extending the work string 112 into the wellbore 114 to position the wellbore servicing apparatus 100 at the desired depth. In another embodiment, the wellbore servicing apparatus 100 or some part thereof may be comprised along and/or integral with the wellbore casing 120.

The wellbore 114 may extend substantially vertically away from the earth's surface 104 over a vertical wellbore portion 116, or may deviate at any angle from the earth's surface 104 over a deviated or horizontal wellbore portion 118. In alternative operating environments, portions or substantially all of the wellbore 114 may be vertical, deviated, horizontal, and/or curved. In some instances, at least a portion of the wellbore 114 may be lined with a casing 120 that is secured into position against the formation 102 in a conventional manner using cement 122. In alternative operating environments, the wellbore 114 may be partially cased and cemented thereby resulting in a portion of the wellbore 114 being uncased (e.g., horizontal wellbore portion 118).

While the exemplary operating environment depicted in FIG. 1 refers to a stationary drilling rig 106 for lowering and setting the wellbore servicing apparatus 100 within a land-based wellbore 114, one of ordinary skill in the art will readily appreciate that mobile workover rigs, wellbore servicing units (e.g., coiled tubing units), and the like may be used to lower the wellbore servicing apparatus 100 into the wellbore 114. It should be understood that the wellbore servicing apparatus 100 may alternatively be used in other operational environments, such as within an offshore wellbore operational environment.

In one or more of the embodiments disclosed herein, the work string 112 comprises the wellbore servicing apparatus 100 or some part of the wellbore servicing apparatus. The wellbore servicing apparatus 100 disclosed herein makes possible the efficient and effective implementation of the concept of downhole composite fluid mixing. The wellbore servicing apparatus 100 may comprise a first tubing member 126 and one or more manipulatable fracturing tools 190. The manipulatable fracturing tool 190 may be integrated within and/or connected to the first tubing member 126. Thus, manipulatable fracturing tools 190 common to a given tubing member will have a common axial flowbore. In an embodiment, the first tubing member 126 may comprise coiled tubing. In another embodiment, the first tubing member 126 may comprise jointed tubing.

Each manipulatable fracturing tool 190 may be positioned proximate or adjacent to a subterranean formation zone 2, 4, 6, 8, 10, or 12 for which fracturing or extending of a fracture is desired. Where multiple manipulatable fracturing tools 190 are employed, the multiple manipulatable fracturing tools 190 may be separated by lengths of tubing. Each manipulatable fracturing tool 190 may be configured so as to be threadedly coupled to a length of tubing (e.g., coiled tubing or jointed tubing/pipe) or to another manipulatable fracturing tool 190. Thus, in operation, where multiple manipulatable fracturing tools 190 will be used, an upper-most manipulatable fracturing tool 190 may be threadedly coupled to the downhole end of the work string. A length of tubing is threadedly coupled to the downhole end of the upper-most manipulatable fracturing tool 190 and extends a length to where the downhole end of the length of tubing is threadedly coupled to the upper end of a second upper-most manipulatable fracturing tool 190. This pattern may continue progressively moving downward for as many manipulatable fracturing tools 190 as are desired along the wellbore servicing apparatus 100. The length of tubing extending between any two manipulatable fracturing tools may be approximately the same as the distance between the formation zone to which the first manipulatable fracturing tool 190 is to be proximate and the formation zone to which the second manipulatable fracturing tool 190 is to be proximate, the same will be true as to any additional manipulatable fracturing tools 190 for the servicing of any additional formation zones 2, 4, 6, 8, 10, or 12. Additionally, a length of tubing threadedly coupled to the lower end of the lower-most manipulatable fracturing tool 190 may extend some distance downhole therefrom. Alternatively, the manipulatable fracturing tools 190 need not be separated by lengths of tubing but may be coupled directly, one to another.

The emission of the fracturing fluid components into the wellbore 114 proximate to the formation zone 2, 4, 6, 8, 10, or 12 is selectively manipulatable via the operation of the one or more manipulatable fracturing tools 190. That is, the ports or apertures of the manipulatable fracturing tool 190 may be actuated, e.g., opened or closed, fully or partially, so as to allow, restrict, curtail, or otherwise alter fluid communication between the interior flowbore of the first tubing member 126 (and/or the interior flowbore of the casing 120 and/or the interior flowbore of a second tubing member 226, where present, as described in more detail herein) and the wellbore 114 and/or the formation 102. Each manipulatable fracturing tool 190 may be configurable independent of any other manipulatable fracturing tool 190 which may be comprised along that same tubing member. Thus, a first manipulatable fracturing tool 190 may be configured to emit fluid therefrom and into the surrounding wellbore 114 and/or formation 102 while a second, third, fourth, etc., manipulatable fracturing tool 190 is not so configured. Said another way, the ports or apertures of one manipulatable fracturing tool 190 may be open to the surrounding wellbore 114 and/or formation zone 2, 4, 6, 8, 10, or 12 while the ports or apertures of another manipulatable fracturing tool 190 along the same tubing member are closed.

In some embodiments, the manipulatable fracturing tool 190 is positioned proximate to the first formation zone 2, 4, 6, 8, 10, or 12 to be serviced. In other embodiments, the manipulatable fracturing tool 190 is positioned proximate to the most downhole formation zone 12 to be serviced, the servicing is performed, and then the manipulatable fracturing tool 190 is removed to the second-most downhole formation zone 10. As such, the servicing operations may proceed to progressively more-upward formation zones 8, 6, 4, or, 2. In other embodiments, a manipulatable fracturing tool 190 may be positioned proximate or substantially adjacent to any one or more of formation zones 2, 4, 6, 8, 10, and 12 to be serviced.

In an embodiment, the manipulatable fracturing tool 190 may be positioned proximate to a formation zone 2, 4, 6, 8, 10, or 12 and a portion of the wellbore 114 adjacent to the formation zone 2, 4, 6, 8, 10, or 12 may be isolated from other portions of the wellbore. In an embodiment, isolating a portion of the wellbore may be accomplished through the use of one or more packers (e.g., Swellpackers™ commercially available from Halliburton Energy Services) or one or more plugs (e.g., a sand plug, a highly viscous proppant plug, or a cement plug).

Each manipulatable fracturing tool 190 may comprise one or more ports or apertures for the communication of fluids with the proximal formation zone 2, 4, 6, 8, 10, or 12. The manipulatable fracturing tool 190 may be positioned such that a fluid flowing through or emitted from the manipulatable fracturing tool 190 will flow into the wellbore 114 proximal to the formation zone 2, 4, 6, 8, 10, or 12 which is to be serviced, thereby establishing a zone of fluid communication between the manipulatable fracturing tool 190 and the wellbore 114 and/or the formation zone 2, 4, 6, 8, 10, or 12. These ports or apertures may be configurable/actuatable to alter the way in which fluid flows through and/or is emitted from the manipulatable fracturing tool 190. That is, in some instances some or all of the ports or apertures may be configured so as to allow communication of fluids with the proximal formation zone 2, 4, 6, 8, 10, or 12. In other instances some or all of the ports or apertures will be configured so as to restrict fluid communication with the proximal formation zone 2, 4, 6, 8, 10, or 12, while, in still other instances some or all of the ports or apertures may be configured to control the rate, volume, and/or pressure at which fluid emitted from the manipulatable fracturing tool 190 communicates with the proximal formation zone, 2, 4, 6, 8, 10, or 12.

Manipulating or configuring the manipulatable fracturing tool 190 may comprise altering the path of fluid flowing through and/or emitted from the manipulatable fracturing tool 190. Configuring the manipulatable fracturing tool 190 to emit fluid therefrom may comprise providing at least one flowpath between the axial flowbore of the first tubing member 126 (and/or the axial flowbore of a second tubing member 226, where present, and/or casing 120) and the wellbore 114 and/or proximal formation zone 2, 4, 6, 8, 10, or 12. Configuring the manipulatable fracturing tool 190 may be accomplished by actuating some number or portion of the ports or apertures. Actuating the ports or apertures may comprise any one or more of opening a port, closing a port, providing a flowpath through the interior flowbore of the manipulatable fracturing tool 190, or restricting a flowpath through the interior flowbore of the manipulatable fracturing tool 190. Actuating these ports or apertures may be accomplished via several means such as electric, electronic, pneumatic, hydraulic, magnetic, or mechanical means. For example, the manipulatable fracturing tool 190 may be configured with any number or combination of valves, indexing check-valves, baffle plates, and/or seats.

In an embodiment, actuating the ports or apertures may be accomplished via an obturation method. In an embodiment such as that shown in FIGS. 4A, 4B, 4C, and 4D, the manipulatable fracturing tool 190 may comprise a seat 182 operably coupled to the one or more ports or apertures 199 of that manipulatable fracturing tool 190 such that a flowpath through those ports or apertures 199 may be altered (although references herein are generally made to a "seat" or "ball seat," it is to be understood that such references shall be to any obturating structure or mechanical assemblage configured and effective for receiving, catching, stopping, or otherwise engaging an obturating member). For example, the obturating structure may comprise a baffle plate, an obturating member seat, an indexing check valve, or combinations thereof. The seat 182 may be positioned so as to engage an obturating member (shown as a ball) 180 introduced into the first tubing member 126 from moving beyond the seat 182. Where an obturating member 180 is introduced into the first tubing member 126 and is pumped there-through via the first axial flowbore 128, the obturating member 180 may engage the seat 182. Alternatively, in an embodiment where the manipulatable fracturing tool 190 is integrated with and/or coupled to the casing 120 (e.g., FIGS. 5A, 5B, and 5C) the obturating member 180 may be introduced into the casing 120 and pumped there-through so as to engage the seat 182. Upon engaging the seat 182, the obturating member 180 may substantially restrict the flow of fluid through the manipulatable fracturing tool 190, such that pressure will increase against the obturating member 180 which will thus exert a force against the seat 182. Exerting sufficient force against the seat 182 will cause the ports or apertures 199 of the manipulatable fracturing tool 190 to open or close, thereby altering a flow of fluid through the manipulatable fracturing tool 190 (as shown by flow arrows 10 and 20 in FIGS. 4A and 5A, respectively) and forming either perforations 175 or fractures.

Figure 7A:
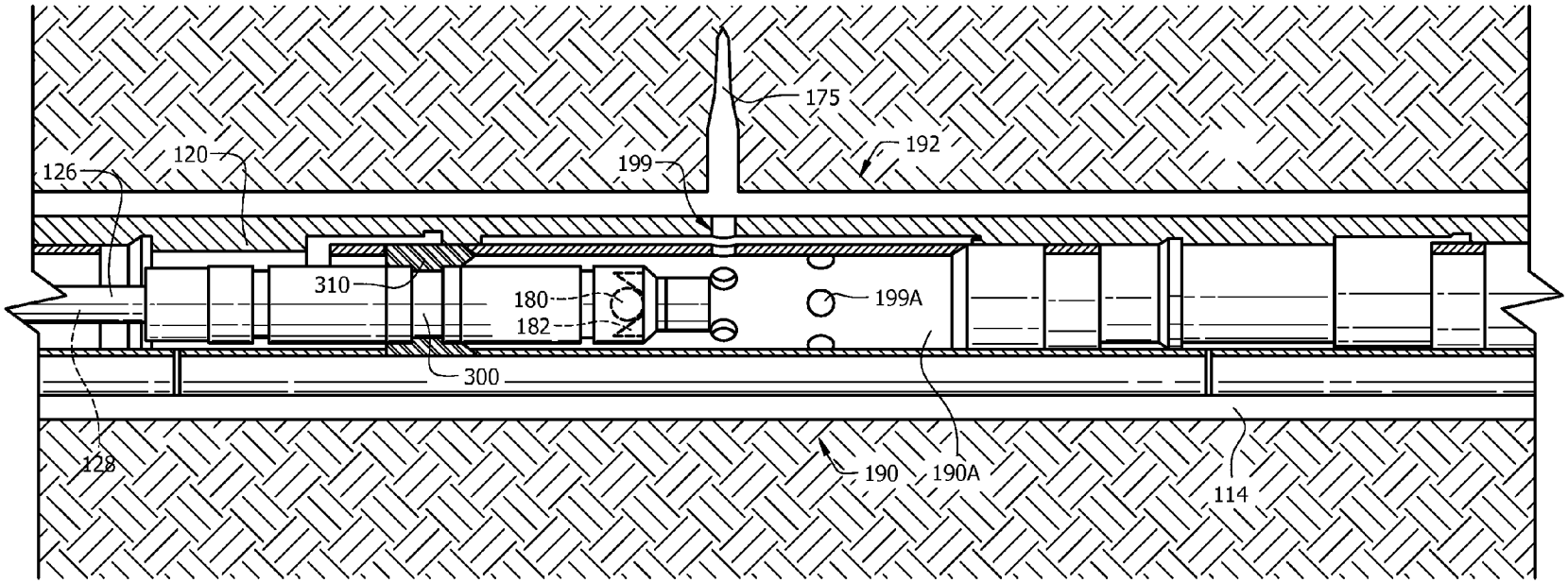
FIG. 7A is a partial cutaway view of a mechanical shifting tool engaging a mechanically-shifted sleeve.

In another embodiment, as shown in FIG. 7A, the manipulatable fracturing tool 190 may further comprise a mechanical shifting tool 300. In such an embodiment, actuating the ports 199 or apertures may be accomplished via the mechanical shifting tool 300. Such a mechanical shifting tool 300 may be axially coupled to a first tubing member 126 which may be disposed within the casing 120 and wherein the casing 120 comprises some part of the manipulatable fracturing tool 190. Alternatively, the first tubing member 126 may be disposed within a second tubing member. The mechanical shifting tool 300 may comprise lugs, dogs, keys, catches 310 (shown as lugs extended and engaging the sliding sleeve 190A of the manipulatable fracturing tool), or a combination thereof configured to engage the manipulatable fracturing tool 190 when the mechanical shifting tool 300 is actuated. The mechanical shifting tool 300 may be actuated hydraulically, pneumatically, mechanically, magnetically, or electrically. In a specific embodiment, actuating the mechanical shifting tool 300 may be accomplished by introducing an obturating member 180 (shown as a ball) into the first tubing member 126 such that the obturating member 180 will engage an obturating assembly/structure such as a seat or baffle plate, e.g., a ball seat 182. Upon engaging the ball seat 182, the obturating member 180 may substantially restrict the flow of fluid through the mechanical shifting tool 300, such that pressure will increase against the obturating member 180 which will thus exert a force against the seat 182. Exerting sufficient force against the seat 182 will cause the mechanical shifting tool 300 to be actuated such that the lugs, dogs, keys, or catches 310, or a combination thereof of the mechanical shifting tool 300 will engage the manipulatable fracturing tool 190. Once the mechanical shifting tool 300 has engaged the manipulatable fracturing tool 190, the mechanical shifting tool 300 may be utilized to shift open or closed the ports or apertures 199 of the manipulatable fracturing tool 190 and thereby alter (e.g., allow or restrict) the flow of fluids between a flowbore of the first tubing member 126 and/or casing 120 and the wellbore 114.

Each manipulatable fracturing tool 190 may comprise at least some portion of ports or apertures 199 configured to operate as a stimulation assembly and at least some portion of ports or apertures 199 configured to operate as an inflow control assembly, thereby allowing selective zone treatment (e.g., perforating, hydrajetting, and/or fracturing) and production, respectively. That is, the stimulation assembly may comprise any one or more ports or apertures 199 operable for the stimulation of a given formation zone (that is, servicing operations such as, for example, perforating, hydrajetting acidizing, and/or fracturing). As explained above, the ports or apertures comprising the stimulation assembly can be independently and selectively actuated to expose different formation zones 2, 4, 6, 8, 10, and/or 12 to formation stimulation operations (that is, via the flow of a treatment fluid such as fracturing fluid, perforating fluid, acidizing fluid, and/or hydrajetting fluid) as desired. The inflow control assembly is discussed at length in U.S. patent application Ser. No. 12/166,257 which is incorporated in its entirety herein by reference. In an embodiment, the inflow control assembly may comprise one or more ports or apertures 199 operable for the production of hydrocarbons from a proximate formation zone 2, 4, 6, 8, 10, and/or 12. That is, when the ports or apertures 199 of the inflow control assembly are so-configured, hydrocarbons being produced from a proximate formation zone 2, 4, 6, 8, 10, and/or 12 will flow into the internal flowbore of the first tubing member 126 or the casing 120 via those ports or apertures 199 configured to operate as an inflow control assembly. As discussed below in greater detail, the different assemblies of a wellbore completion apparatus may be configured in the formation zone in any suitable combination.

The wellbore servicing methods, wellbore servicing apparatuses, and wellbore servicing systems disclosed herein include embodiments for stimulating the production of hydrocarbons from subterranean formations, wherein two or more components of a composite wellbore servicing fluid are introduced into a wellbore from two or more flowpaths such that the composite fluid may be mixed proximate to one or more formation zones (e.g., zones 2, 4, 6, 8, 10, or 12 of FIG. 1) into which the composite fluid will be pumped. In an embodiment, the method comprises the steps of inserting a wellbore servicing apparatus 100 comprising one or more manipulatable fracturing tools 190 into the wellbore 114; positioning the manipulatable fracturing tool(s) 190 proximate to a formation zone 2, 4, 6, 8, 10, or 12 to be fractured; introducing a first component of a composite fluid into the wellbore 114 via a first flowpath; introducing a second component of the composite fluid into the wellbore 114 via a second flowpath; establishing a zone of fluid communication with the formation zone 2, 4, 6, 8, 10, or 12 to be fractured via the operation of the manipulatable fracturing tool 190; mixing the first component of the composite fluid with the second component of the composite fluid within the wellbore 114; and causing a fracture to form or be extended within the formation zone 2, 4, 6, 8, 10, or 12. The composite fluid may comprise a perforating fluid, a fracturing fluid, a proppant laden fluid, an acidizing fluid, a pre-flush fluid, a flush fluid, an isolation fluid, or any combination thereof.

In embodiments, the instant application discloses methods, systems, and apparatuses for real-time wellbore servicing operations in which resultant composite fluids are achieved via flow of one or more component fluids through a manipulatable fracturing tool prior to, after, or concurrent with blending the components to form the composite fluid. Such flow and blending may occur in varying locals, for example, proximate to one or more selected formation zones 2, 4, 6, 8, 10, or 12. These methods may be accomplished by providing multiple flowpaths through which different components of the composite fluids may be transferred and then selectively emitted from one or more manipulatable fracturing tools 190.

In an embodiment, a composite fracturing fluid is created downhole prior to injection into the formation zone (e.g., zones 2, 4, 6, 8, 10, or 12 of FIG. 1). The first component of the fracturing fluid and/or the second component of the fracturing fluid is flowed through a manipulatable fracturing tool 190 and are mixed within a downhole portion of the wellbore 114 proximate to a formation zone 2, 4, 6, 8, 10, or 12. The mixing may also be proximate to one or more perforations. Thus, the component fluids of the composite fracturing fluid are mixed within a downhole portion of the wellbore 114 proximate to an exposed formation zone 2, 4, 6, 8, 10, or 12. Thereafter, the fracturing fluid components are introduced into the formation zone 2, 4, 6, 8, 10, or 12. First component and second component as used herein are non-limiting, and more than two components may be used where appropriate to create a desired wellbore servicing fluid such as a fracturing fluid. Likewise, each component of the fluid may comprise a plurality of ingredients such that when the given number of components are combined, a wellbore servicing fluid (e.g., fracturing fluid) having a desired composition is formed.

The concept of mixing one or more fluids of a composite wellbore servicing fluid proximate to the formation zone 2, 4, 6, 8, 10, or 12 to be serviced as in accordance with the embodiments disclosed herein provides the operator with a number of advantages. The ability to alter the concentration of, for example, a proppant in the composite fluid entering the formation 102 within the wellbore 114 proximate to the formation zone 2, 4, 6, 8, 10, or 12 may alleviate the need for certain equipment while improving operator control. For example, because mixing may be accomplished within the wellbore 114, the need for mixing equipment and numerous storage tanks at the surface 104 may be lessened or alleviated. Specifically, these methods may lessen or alleviate the need for equipment such as sand conveyors and sand storage units, high-rate blending equipment, erosion resistant pumping equipment, and erosion-resistant manifolding. Components of the composite fluids may be mixed off-sight and transported to the surface 104 proximate to the wellbore 114. Specifically, it is contemplated that Halliburton's "Liquid Sand," a premixed concentrated proppant mixture, may be utilized in accordance with the methods, systems, and apparatuses disclosed herein. Metering pumps may be employed to incorporate any additives (e.g., gels, cross-linkers, etc.) into a fluid being introduced into the wellbore; that is, conventional high-rate blending equipment may not be necessary in employing the instant methods, systems, or apparatuses. In contrast to conventional fracturing methods requiring blenders, proportioners, dry additive conveyors and storage equipment for proppant, the instant methods, systems and apparatuses alleviate much of the need for such equipment. In an embodiment, component fluids may be mixed off-sight and transported as pre-mixed component fluids. At the site, the fluid components may be introduced into the wellbore 114 (discussed further below). Further, the instant methods, systems and apparatuses allow for decreased operation of pumps in the presence of abrasives. For example, a given volume of abrasive-containing fluid may be pumped downhole via a first flowpath followed by an abrasive-free fluid while an abrasive-free fluid is pumped down a second flowpath. In this way, very little abrasive-containing fluid is introduced into the pumps. Thus, the costs associated with the maintenance, repair, and operation of pumping equipment may be lessened.

Further, in an embodiment, the instant methods, systems and apparatuses allow for servicing operations with brine solutions which would not be workable utilizing conventional pumping methods, systems, and apparatuses. In some instances, a fluid utilized for the purpose of transporting a proppant downhole or into a formation 102 will be hydrated so as to form a viscous "gel" suitable for proppant transport (i.e., the viscosity of the gel lessens the tendency of the proppant contained therein to settle out). When the gelled or hydrated proppant-laden fluid reaches its destination, the fluid may be mixed with a brine solution so that the fluid ceases to exist as a gel and thus deposits the proppant contained therein. In accordance with the instant methods, systems, and apparatuses, gels which have undergone hydration may be mixed in a downhole portion of the wellbore 114 with a brine solution which will cause the gel to no longer be hydrated. In an embodiment, a gel (e.g., concentrated proppant gel) may be pumped down the tubing and a diluent brine fluid/solution may be pumped down the annulus between the tubing and casing/wellbore. As such, proppant transport may be enhanced.

Further, the instant methods, systems, and apparatuses may allow the operator to have greater freedom as to the pumping rates and proppant concentrations which may be employed. In prior wellbore servicing operations, an operator would be limited as to the rate at which fluids containing particulate matter, abrasives, or proppant might be pumped. By pumping the component fluids via separate flowpaths, greater pumping rates may be achieved. For example, a fluid not containing any abrasive, proppant, or particulate may be pumped via a given flowpath at a much higher rate than the rate at which a fluid containing an abrasive, proppant or particulate might be pumped. Thus, an operator is able to achieve effective pumping rates which would otherwise be unachievable without adverse consequences. That is, when the components of the composite fluid are not mixed within the wellbore 114 proximate to a given formation zone 2, 4, 6, 8, 10, or 12, but rather are mixed at the surface and then pumped down the wellbore, the rate at which the composite fluid may be pumped downhole is significantly less than the rates achievable via the instant disclosed methods.

Further still, the increased control available to the operator via the operation of the instant methods, systems and apparatuses allow the operator to manage (i.e., avoid, or remediate) a potential screenout condition by reducing or stopping the pumping of the concentrated proppant-laden component to allow instantaneous overflushing (i.e., decreasing the effective concentration of proppant in the fluid entering the formation 102) of the fracture with non-abrasive annulus fluid, discussed herein. Thus, a potential screenout condition may be avoided without necessitating the cessation of servicing operations and the loss of time and capital. Alternatively, the ability to control and alter downhole proppant concentration in accordance with the present methods, systems, and apparatuses will allow the operator to instantaneously increase in the effective proppant concentration. Thereby, the operator may elect to set a proppant slug volume and thereby enable the bridging of fractures inside the rock, thus creating branch fractures. The value of the potential to monitor treatment parameters and instantaneously make changes such as increase or decrease the effective proppant concentration related to the treatment stages is great, particularly when compared to conventional methods requiring these decisions to be made with an entire wellbore volume before the changes are realized.

The relative quantity of the first and second components of the composite fracturing fluid flowed through the manipulatable fracturing tool may be varied, thus resulting in a composite fracturing fluid of variable concentration and character. In an embodiment, one of the first or second fracturing fluid components may comprise a concentrated proppant laden slurry. The other of the first or second fracturing fluid components may comprise any fluid with which the concentrated proppant slurry might be mixed so as to form the resultant composite fracturing fluid (e.g., a diluent). When the concentrated proppant laden slurry is mixed with the other fracturing fluid component, the composite fracturing fluid results. The relative quantity and/or concentration of the proppant laden slurry provided for downhole mixing may be increased in a situation where more proppant is desired (conversely, the relative quantity may be decreased where less is desired). Likewise, the relative amount of diluent provided for mixing may be adjusted where a different viscosity or proppant-concentration composite fracturing fluid is desired. Thus, by varying the respective mixing rates of the concentrated proppant laden slurry and the diluent, a composite fracturing fluid of a desired concentration and viscosity may be achieved.

For example, the net composition of the composite fracturing fluid may be altered as desired by altering the rates or pressures at which the first and second components are pumped. Although, the pumping equipment delivering the first and second components is located at the surface 104, like a syringe the effectuated increase in pumping rate or pressure as to the first or second flowpath is immediately realized at the downhole portion of the wellbore 114 where the mixing occurs. As a result, changes to the concentration or viscosity of the fracturing fluid can be adjusted in real-time by changing the proportion of the components of the fracturing fluid. That is, the pump rate or pressure of the component fluids in one or both of the flowpaths may be selectively and individually varied to effect changes in the composition of the composite fluid, substantially in real time, thus allowing the operator to exert improved control over the fracturing process.

As those of ordinary skill in the art understand, fracturing is but one component of wellbore servicing operations. As explained within the context of fracturing, above, acidizing operations, perforating operations, isolation operations, and flushing operations may all be achieved by utilizing the instant disclosed apparatuses with multiple flowpaths and/or the instantly disclosed methods and processes of utilizing said apparatuses to realize the placement of a composite fluid at a specific location within a wellbore. For example, a concentrated acid solution may be introduced into the wellbore proximate to a formation zone 2, 4, 6, 8, 10, or 12, and diluted with fluid introduced via another flowpath to achieve an acid solution of a desired concentration. Thus, the volume of acid to be utilized in any given operation may be substantially lessened due to the fact that the concentrated solution may be diluted at the interested local. This same concept is true for any of the wellbore servicing operations discussed herein, thereby lessening the capital intensive nature of such wellbore servicing operations. Furthermore, the implementation and utilization of separate and distinct flowpaths allows for the recovery and later utilization of any components introduced via such flowpaths, further improving the economies of such operations. Moreover, the utilization of the separate flowpath concept and mixing at a specific local provides the operator with the ability to control any such wellbore operations in real-time by allowing for pin-point control of composite fluid character.

A first component of a composite fluid may be introduced into a portion of the wellbore 114 which is proximate to the formation zone 2, 4, 6, 8, 10, or 12 via a first flowpath and a second component of the composite fluid is introduced into a portion of the wellbore 114 which is proximate to the formation zone 2, 4, 6, 8, 10, or 12 via a second flowpath. In alternative embodiments, the composite fluids may be introduced into the wellbore 114 and proximate to the formation zone, 2, 4, 6, 8, 10, or 12 via a first flowpath, a second flowpath, a third flowpath, or any number of multiple flowpaths as may be deemed necessary or appropriate at the time of wellbore servicing.

Each of the first flowpath and the second flowpath comprises a route of fluid communication between the surface and the point proximate to which the fluid enters the formation. The flowpath may comprise a means of mixing constituents of the component fluids, a means of pressurizing the component fluids, one or more pumps, one or more conduits through which the component fluids may be communicated downhole, and one or more ports or apertures 199 (e.g., in one or more manipulatable downhole tools) by which the component fluids exit the flowpath and enter the wellbore 114 proximate to the formation zone 2, 4, 6, 8, 10, or 12. Thus, in an embodiment, any of the components of the fracturing fluid may be at prepared at the surface 104 and the components mixed with each other to form a composite fracturing fluid mixed within the wellbore 114 proximate to the formation zone 2, 4, 6, 8, 10, or 12.

Figure 2:
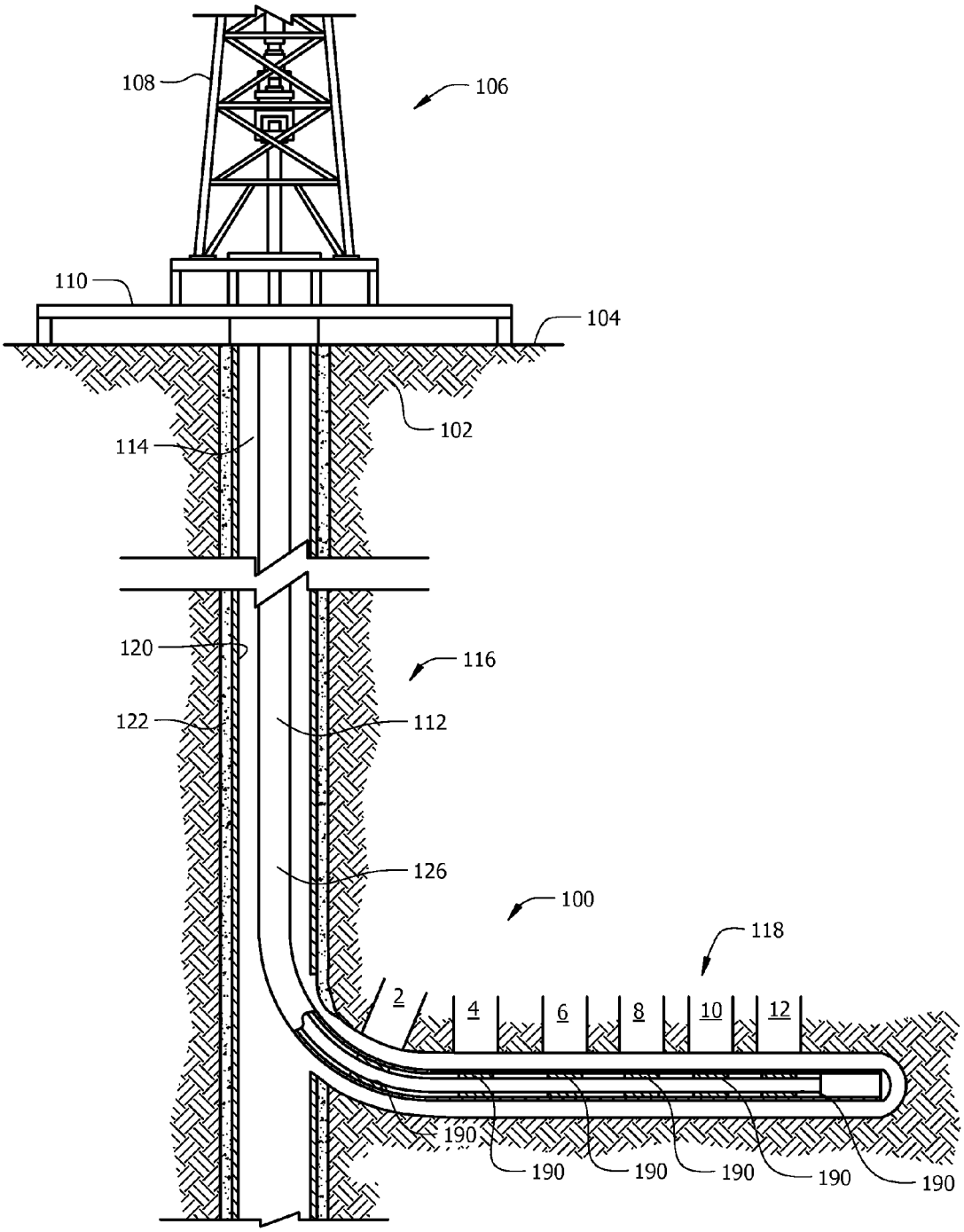
FIG. 2 is a cutaway view of a wellbore servicing apparatus comprising multiple manipulatable fracturing tools integrated with a second tubing member disposed within a first tubing member.
Figure 3:
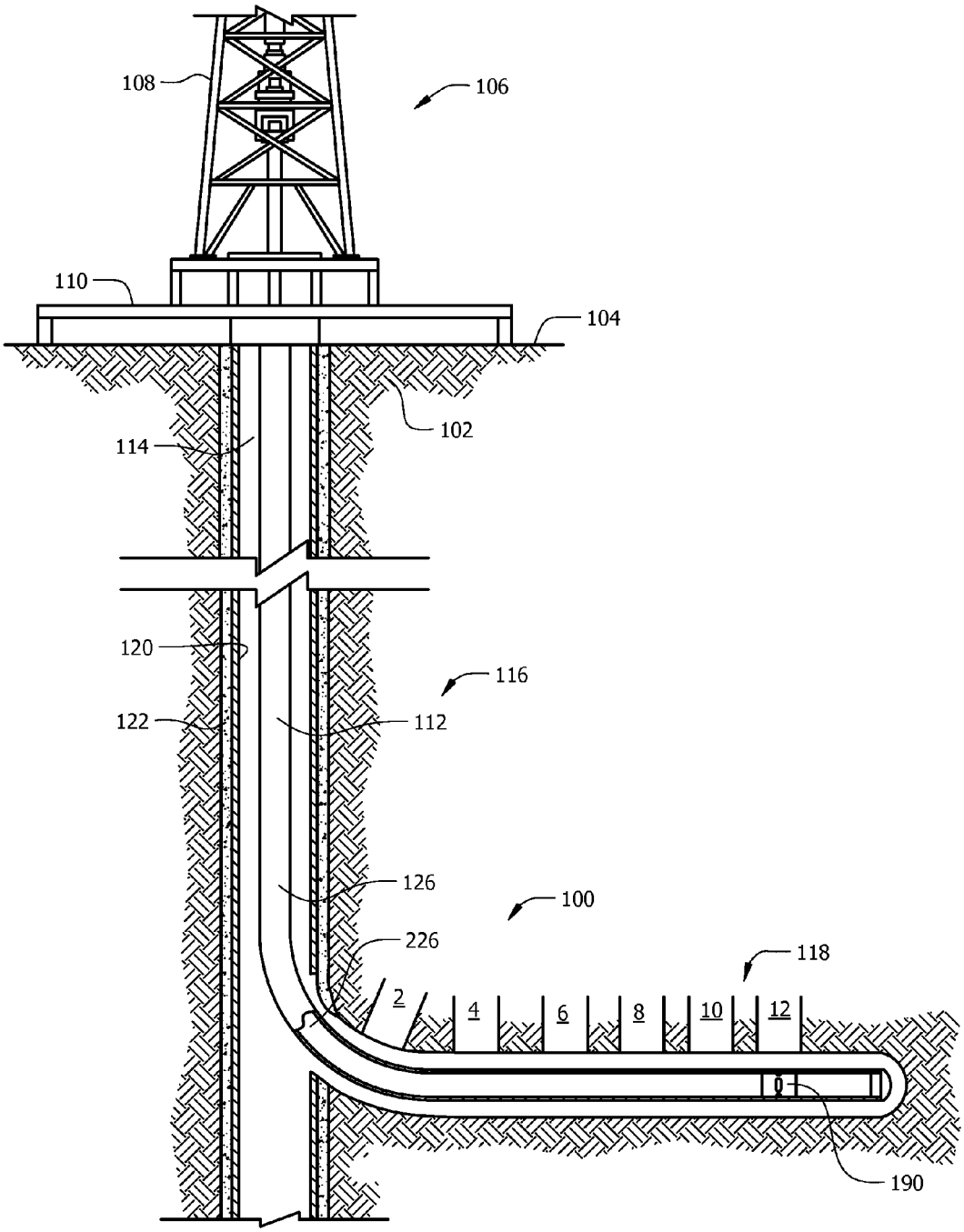
FIG. 3 is a cutaway view of a wellbore servicing apparatus comprising a single manipulatable fracturing tool integrated with a first tubing member.

While the preceding discussion has primarily been with reference to FIG. 1, it is noted that the previously described methods, systems, and apparatuses may likewise be embodied as depicted in FIGS. 2 and 3. In the embodiment illustrated by FIG. 2, multiple manipulatable fracturing tools 190 integrated within the casing are positioned proximate to formation zones 2, 4, 6, 8, 10, and 12. In an embodiment as depicted in FIG. 2, a mechanical shifting tool 300 coupled to the downhole terminus of a first tubing member 126 is disposed within the casing. The axial flowbore of the first tubing member 126 may comprise one of the first or second flowpaths and the annular space between the first tubing member 126 and casing 120 may comprise the other of the first or second flowpaths.

In the embodiment depicted by FIG. 3, a single manipulatable fracturing tool 190 (e.g., a hydrajetting tool) is integrated within a first tubing member 126. The manipulatable fracturing tool 190 may suitably be configured to operate as a hydrajetting or perforating tool, upon being actuated as previously described. Upon actuation, the manipulatable fracturing tool 190 will be configured to emit a high-pressure stream of fluids via the ports or apertures. The first axial flowbore 128 of the first tubing member 126 may comprise one of the first or second flowpaths and the annulus 135 about the first tubing member 126 may comprise the other of the first or second flowpaths.

In an embodiment, each of the first flowpath and the second flowpath is independently manipulatable as to pumping rate and pressure. That is, the rate and pressure at which a fluid is pumped through the first flowpath may be controlled and altered independently of the rate and pressure at which a second fluid is pumped through the second flowpath and vice versa. In additional embodiments comprising a wellbore apparatus 100 with multiple flowpaths (i.e., 2, 3, etc. or more flowpaths) each of the rate and/or pressure at which fluid is pumped through each of the flowpaths may be independently controlled.

In an embodiment, the first flowpath may comprise the interior flowbore of coiled tubing or jointed tubing and the first fluid component may comprise a concentrated proppant-laden fluid. The second flowpath may comprise the annular space extending between the coiled tubing or jointed tubing and the interior wall of the casing and the second fluid component may comprise water or an oil-water mixture. The concentrated proppant-laden fluid is introduced into the coiled or jointed tubing at a first rate (which may be varied as the operator elects) and the water or water-oil mixture is introduced into the annular space at a second rate. The operator may be limited as to the rate at which the proppant-laden fluid is pumped through the coiled or jointed tubing because of the abrasive nature of a particulate-containing fluid (i.e., where the proppant laden fluid is pumped at a rate exceeding approximately 35 ft./sec., the particulate may have the effect of abrading or otherwise damaging the coiled or jointed tubing). In accordance with the instant methods, the proppant-laden fluid may be pumped down the coiled or jointed tubing at a rate which will not damage or abrade the coiled or jointed tubing and the water or water-oil mixture may be pumped down the annular space at a much higher rate (i.e., because the water or water-oil mixture is generally non-abrasive in nature). Thus, the proppant-laden fluid may be mixed with the water or water-oil mixture proximate to the formation zone 2, 4, 6, 8, 10, and/or 12. The mixed composite fluid may then be introduced into the formation zone 2, 4, 6, 8, 10, and/or 12. Because the operator is not limited as to the rate at which the water or water-oil mixture may be pumped, far greater effective pumping rates (i.e., the rate at which the composite fluid is entering the formation zone 2, 4, 6, 8, 10, and/or 12) may be achieved.

In another embodiment, the first flowpath may again comprise the interior flowbore of coiled tubing or jointed tubing and the first fluid component may comprise a concentrated proppant-laden fluid. The second flowpath may again comprise the annular space extending between the coiled tubing or jointed tubing and the interior wall of the casing and the second fluid component may comprise water or an oil-water mixture. The concentrated proppant-laden fluid is introduced into the coiled or jointed tubing at a first rate (which may be varied as the operator elects) and the water or water-oil mixture is introduced into the annular space at a second rate. It may be desirable to place a "proppant slug" in certain situations or formation types (i.e., conditions that would cause high fracturing entry friction). The operator may elect to introduce a proppant slug in the formation zone 2, 4, 6, 8, 10, and/or 12 by reducing the pumping rate of the water or water-oil mixture. In so doing, a volume of concentrated proppant-laden fluid (i.e., a proppant slug) is introduced into the formation zone 2, 4, 6, 8, 10, and/or 12. The operator may increase the pumping rate of the water or water-oil mixture to force the proppant slug further into the formation zone 2, 4, 6, 8, 10, and/or 12. Thus, a proppant slug may be set by varying the respective pumping rates of the proppant-laden fluid and the water or water-oil mixture. In accordance with the instant methods, systems and apparatuses a proppant slug may be set without varying the concentration of the fluids introduced into the wellbore 114 at the surface 104.

In still another embodiment, the first flowpath may again comprise the interior flowbore of coiled tubing or jointed tubing and the first fluid component may comprise a concentrated proppant-laden fluid. The second flowpath may again comprise the annular space extending between the coiled tubing or jointed tubing and the interior wall of the casing and the second fluid component may comprise water or an oil-water mixture. The concentrated proppant-laden fluid is introduced into the coiled or jointed tubing at a first rate (which may be varied as the operator elects) and the water or water-oil mixture is introduced into the annular space at a second rate. The instant methods, systems, and apparatuses may be used to implement a "ramped" or "stepped" proppant placement schedule (i.e., a proppant-pumping schedule in which the concentration of proppant in the fluid entering the formation zone 2, 4, 6, 8, 10, and/or 12 is varied over time). In such a ramped proppant placement schedule the concentration of proppant entering the formation zone 2, 4, 6, 8, 10, and/or 12 may be progressively and/or continuously increased or decreased. The present methods, systems, and apparatuses allow for the delivery and placement of a ramped or stepped proppant schedule without necessitating multiple mixtures of varying proppant concentration (i.e., the same fluid components may be utilized at every point in the ramped or stepped proppant scheme). The effective difference in concentration of the composite fluid entering the formation zone 2, 4, 6, 8, 10, and/or 12 is achievable by manipulating the rates of injection of the component fluids in their respective flowpaths. Thus, in accordance with the instant methods, systems and apparatuses the ramped or stepped proppant schedule is achieved by varying the pumping rates of the first fluid component with respect to the second fluid component.

In still another embodiment, the first flowpath may again comprise the interior flowbore of coiled tubing or jointed tubing and the first fluid component may comprise a concentrated proppant-laden fluid. The second flowpath may again comprise the annular space extending between the coiled tubing or jointed tubing and the interior wall of the casing and the second fluid component may comprise water or an oil-water mixture. The concentrated proppant-laden fluid is introduced into the coiled or jointed tubing at a first rate (which may be varied as the operator elects) and the water or water-oil mixture is introduced into the annular space at a second rate. The instant methods, systems, and apparatuses may be used to place a plug (e.g., a sand plug). In such an embodiment, a plug may be desirably placed so as to block one or more formation zones 2, 4, 6, 8, 10, and/or 12. The placement of plugs may be varied over time and may be utilized to block the entry of fluids, materials or other substances into the plugged formation zones 2, 4, 6, 8, 10, and/or 12. The present methods, systems, and apparatuses allow for the delivery and placement of a plug without necessitating additional mixtures of fluids.

In various embodiments, the ports and/or apertures 199 of the manipulatable fracturing tool 190 may vary in size or shape or orientation and may be configured to perform varying functions. In an embodiment, the manipulatable fracturing tool 190 may be configured to operate as a perforating tool, for example, a hydrajetting tool and/or a perforating gun. Hydrajetting operations are described in greater detail in U.S. Pat. No. 5,765,642 to Surjaatmadja, which is incorporated in its entirety herein by reference. In such an embodiment, some portion of the ports or apertures 199 of the manipulatable fracturing tool 190 may be fitted with nozzles and/or perforating charges such as shaped charges. In an embodiment, as depicted in FIGS. 4A and 4B, the manipulatable fracturing tool 190 may comprise at least one, and more often, multiple hydrajetting nozzles.

Figure 4A:
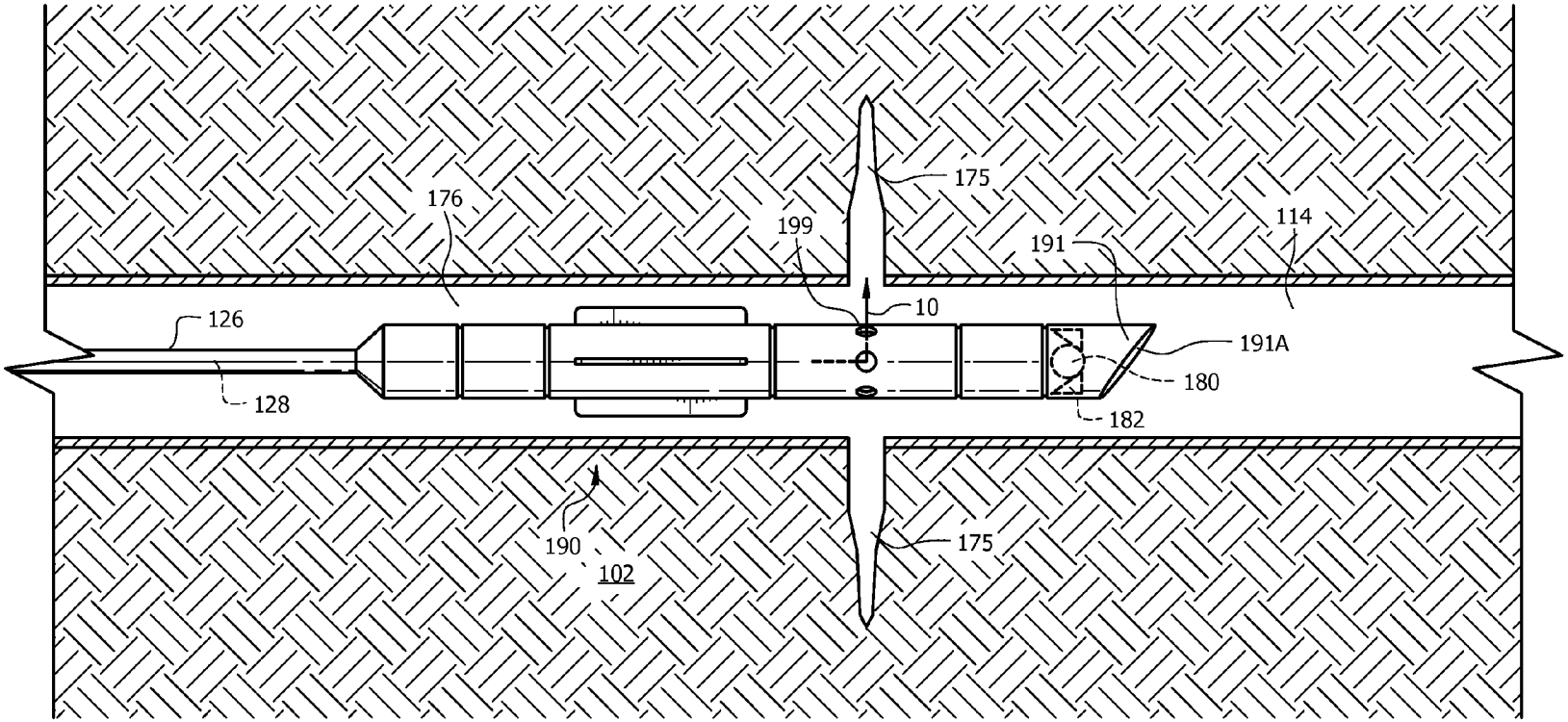
FIG. 4A is a side view of a manipulatable fracturing tool depicting a fluid emitted from hydrajetting nozzles.
Figure 4B:
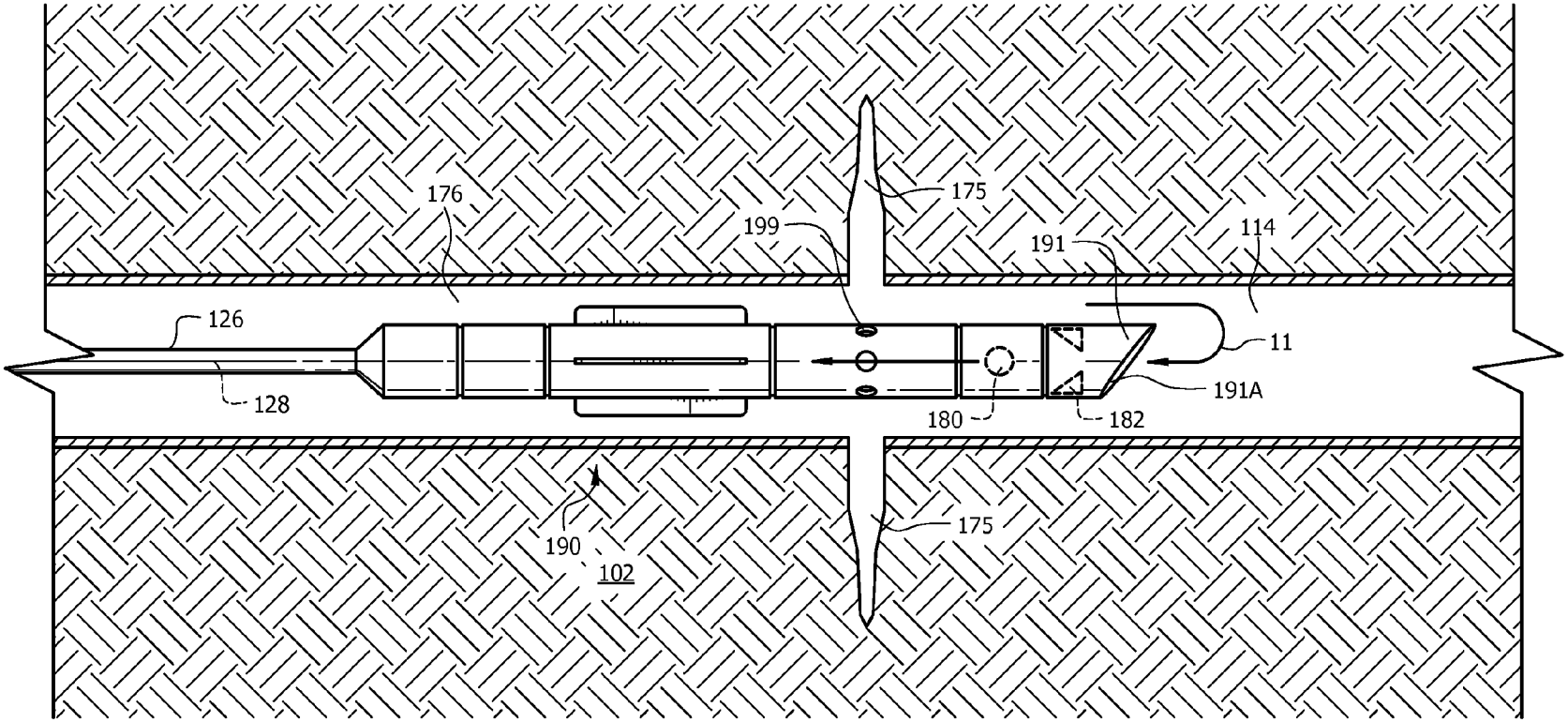
FIG. 4B is a side view of a manipulatable fracturing tool depicting an obturating member being disengaged from the seat.
Figure 4C:
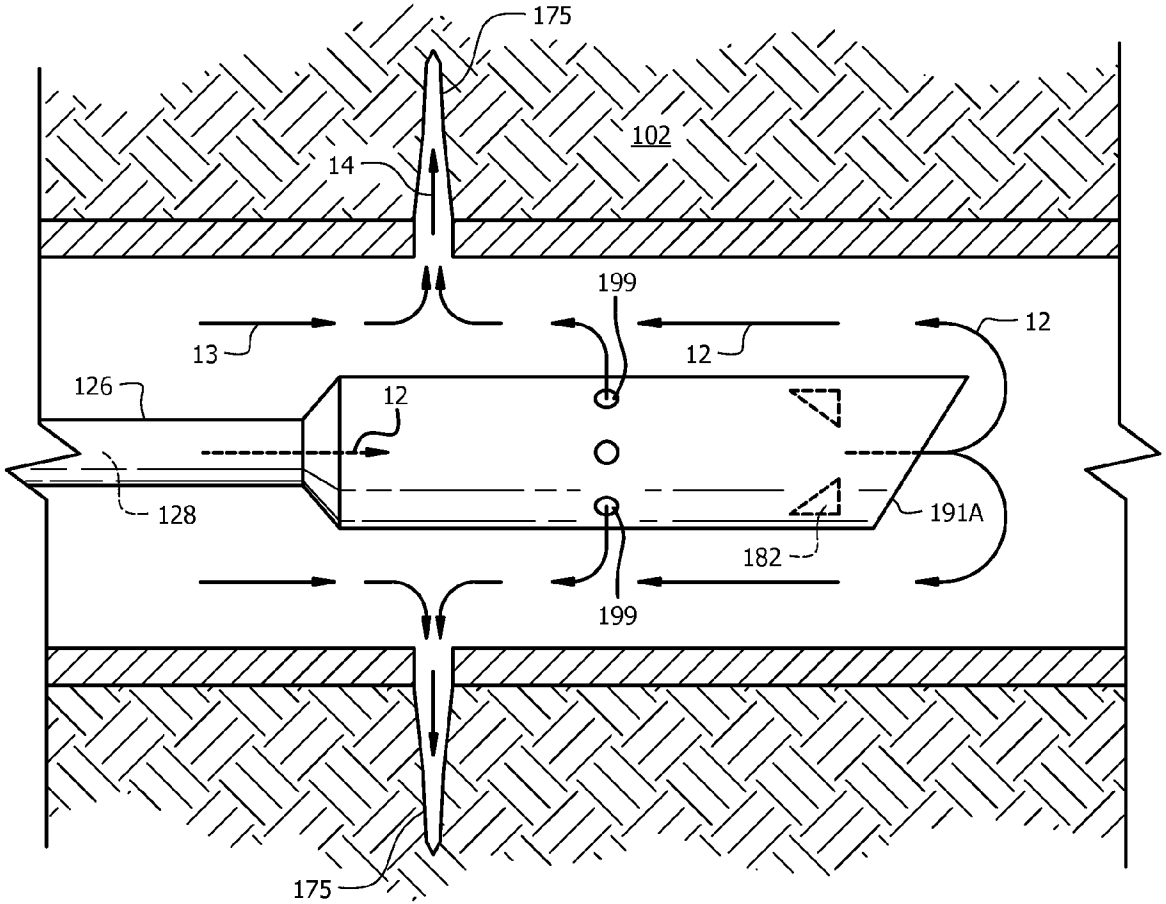
FIG. 4C is a side view of a manipulatable fracturing tool depicting a flow of fluid being emitted therefrom, mixing with a second fluid to form a composite fluid, and entering the formation.
Figure 4D:
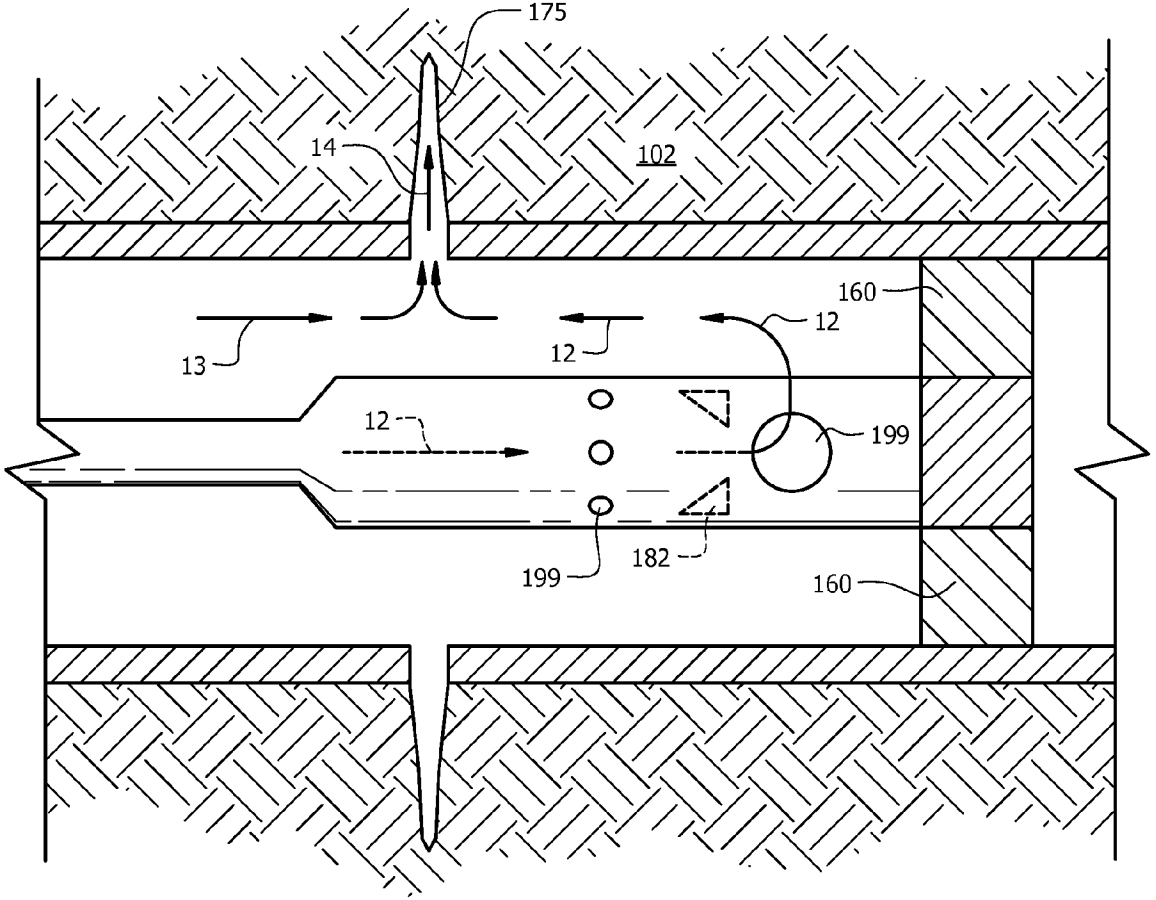
FIG. 4D is a side view of a manipulatable fracturing tool depicting a flow of fluid being emitted therefrom, mixing with a second fluid to form a composite fluid, and entering the formation.

As shown in FIG. 4A, when the obturating member 180 engages the seat 182 and substantially restricts the flow of a fluid, the fluid may be emitted from the ports or apertures 199 fitted with nozzles as a high pressure stream of fluid (as shown by flow arrow 10). Such a configuration of the manipulatable fracturing tool 190 may be appropriate for the relatively high-pressure, low-volume delivery of fluid. This high pressure stream of fluid may be sufficient to degrade (i.e., to abrade, cut, perforate, or the like) the casing, lining, or formation 102 for fracturing. Additionally, the high pressure stream of fluid may be used initiate and/or extend a fracture in the formation 102. In these embodiments, following perforating and/or fracture initiation operations, the manipulatable fracturing tool 190 may be configured such that it no longer emits a high-pressure stream of fluid via the hydrajetting nozzles. In other words and as shown in FIG. 4B, the manipulatable fracturing tool 190 may be configured via the actuation of the obturating member 180 to disengage from the seat 182 thereby allow for the axial flow of fluid to occur through the first axial flowbore 128 and prevent the high-pressure emission of fluid via the nozzles. The obturating member 180 may be reverse-circulated and removed from the axial flowbore (as shown by flow arrow 11). As shown by FIGS. 4C and 4D, the reverse-circulation and removal of the obturating member 180 allows a volume of fluid to be emitted (as shown by flow arrow 12) from the downhole end of manipulatable fracturing tool 190 (as shown by FIG. 4C) and/or from ports or apertures 199 that may be uphole and/or downhole from the seat 182 (FIG. 4D). In some embodiments as shown in FIGS. 4C and 4D, the emission of fluid will be at a pressure less than necessary for hydrajetting or perforating (e.g., via a flowpath which had previously been obstructed by the obturating member). Such a configuration of the manipulatable fracturing tool 190 may be appropriate for the relatively low-pressure, high-volume delivery of fluid. Further, such a configuration of the manipulatable fracturing tool 190 may be appropriate for the delivery of fluid at a pressure and/or flow rate (i) less than that sufficient to degrade a liner, the casing 120, the formation zone 2, 4, 6, 8, 10, or 12 or combinations thereof and (ii) equal to or greater than that sufficient to propagate fractures in the formation zone 2, 4, 6, 8, 10, or 12. The prevention of high-pressure emission of fluid through the nozzles prevents the manipulatable fracturing tool 190 from operating as a perforating tool. Although FIGS. 4A, 4B, 4C, and 4D represent a configuration of the manipulatable fracturing tool 190 utilizing a ball and ball seat scenario, the instant apparatus and methods should not be construed as so-limited.

Figure 5A:
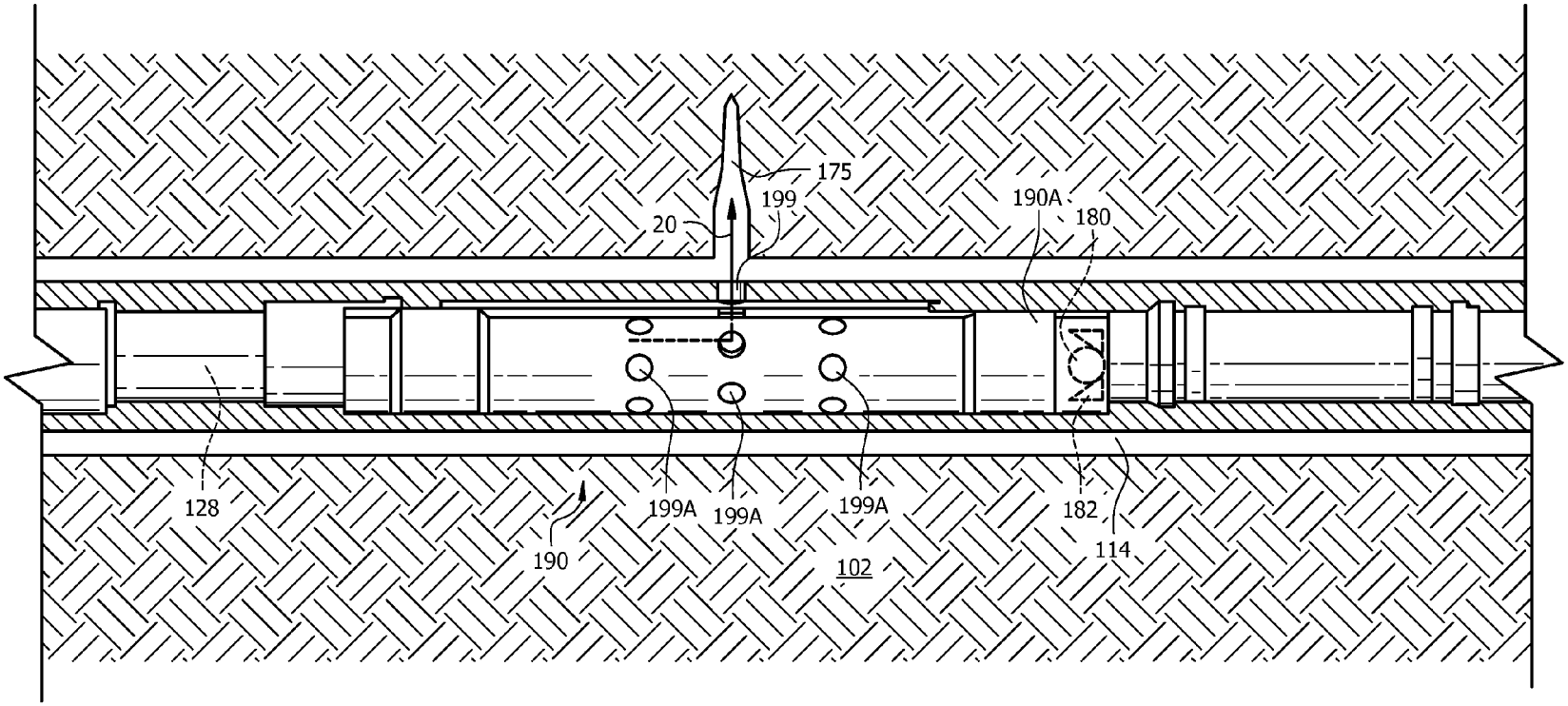
FIG. 5A is a side view of a manipulatable fracturing tool having a sliding sleeve and depicting an obturating member engaging the seat and a fluid being emitted from aligned ports.
Figure 5B:
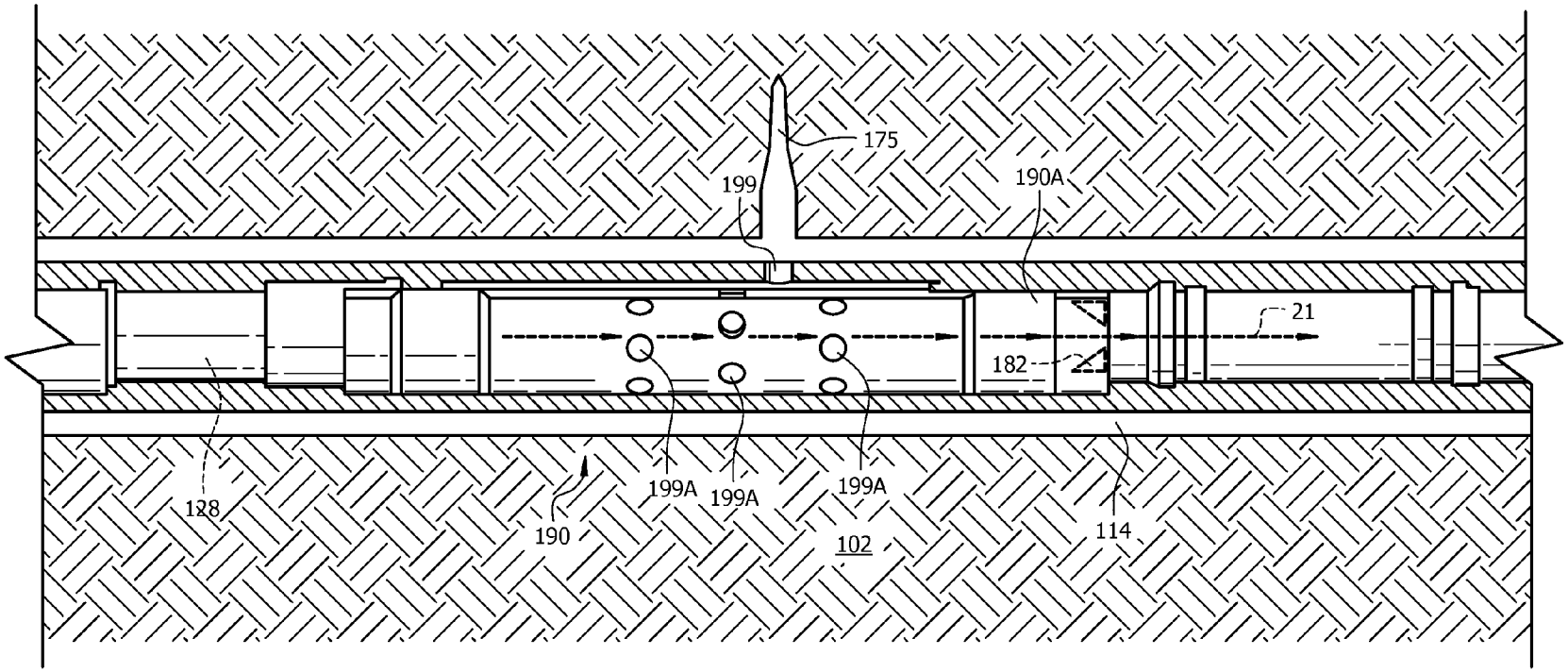
FIG. 5B is a side view of a manipulatable fracturing tool having a sliding sleeve, depicting the ports in an unaligned position.
Figure 5C:
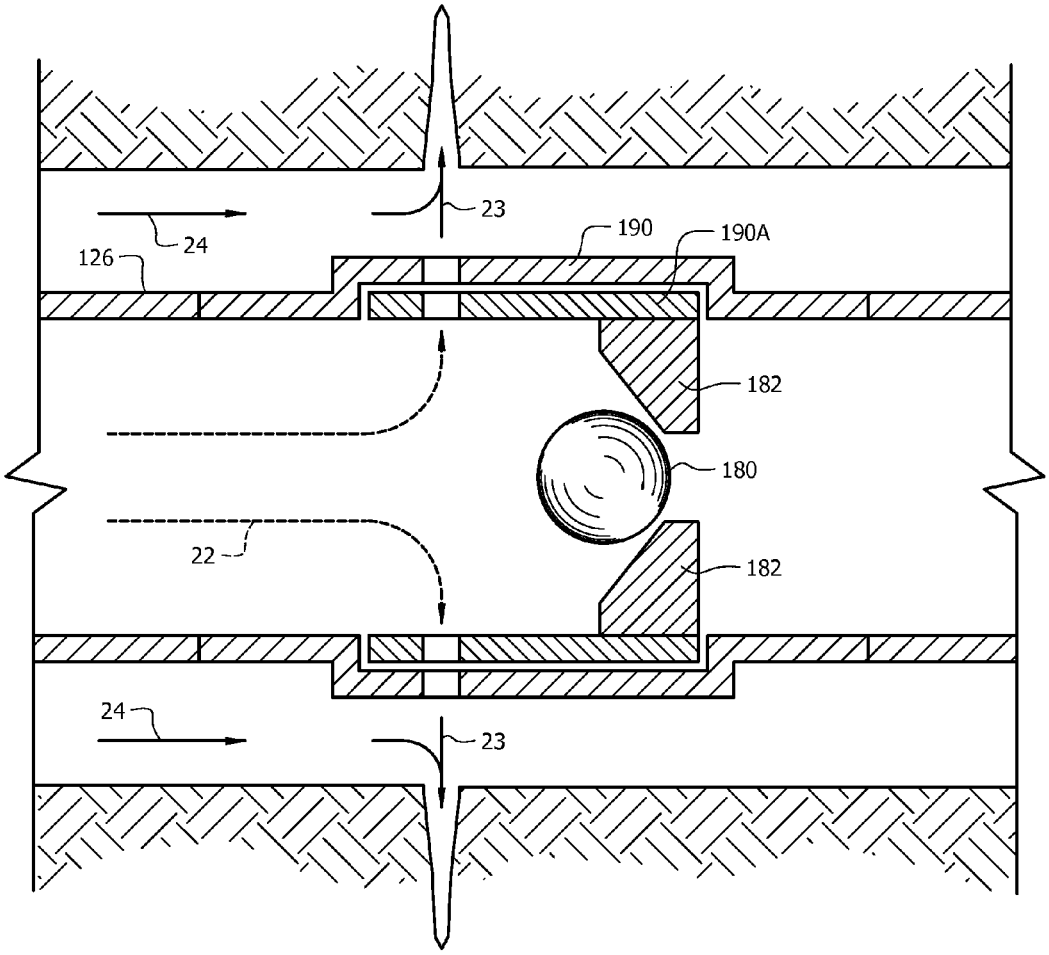
FIG. 5C is a side view of a manipulatable fracturing tool having a sliding sleeve and depicting an obturating member engaging the seat and depicting a fluid being emitted therefrom and mixing with a second fluid to form a composite fluid which enters the formation.

In another embodiment depicted in FIGS. 5A, 5B, and 5C the manipulatable fracturing tool 190 is configured to establish a zone a fluid communication between the first flowbore 128 and the wellbore 114 when the ports or apertures 199 are so configured. In such an embodiment, the ports or apertures 199 may be opened and/or closed via the operation of a sliding sleeve 190A, the sliding sleeve 190A being a component of the manipulatable fracturing tool 190. As shown in FIG. 5A, in operation an obturating member 180 engages the seat 182, the seat being operably coupled to the sliding sleeve 190A of the manipulatable fracturing tool 190 and the sliding sleeve 190A having ports or apertures 199A which, when actuated, will align with the ports or apertures 199 of the manipulatable fracturing tool, thus establishing a zone of fluid communication with the wellbore 114 (as shown by flow arrow 20). Such a configuration of the manipulatable fracturing tool 190 may be appropriate for the relatively low-volume, high-pressure delivery of fluid to form perforations 175 and/or initiate/extend fractures into the formation. As depicted in FIG. 5B, when the obturating member is removed the sliding sleeve 190A may be configured such that the ports or apertures 199A of the sliding sleeve 190A will no longer be aligned with the ports or apertures 199 of the manipulatable fracturing tool 190, thus altering the zone of fluid communication with the wellbore 114 and allowing fluid to flow through the flowbore of the manipulatable fracturing tool 190 (as shown by flow arrow 21).

In an exemplary embodiment, the ports or apertures 199 may comprise doors, windows, or channels (e.g., the flowpath out of the downhole terminal end of the manipulatable fracturing tool 190) which, when open or non-obstructed, will allow for a high volume of fluid to pass from the interior flowpath(s) (e.g., flowpath 128) of the manipulatable fracturing tool 190 into the wellbore, as might be necessary, for example, in a fracturing operation. Such a configuration of the manipulatable fracturing tool 190 may be appropriate for the relatively higher-volume, lower-pressure delivery of fluid to initiate and/or extend fractures into the formation. As with the embodiments discussed previously with regard to FIGS. 5A and 5B, the ports or apertures 199 may be opened and closed for example by shifting a sliding sleeve mechanically or via hydraulic pressure (e.g., a ball and seat configuration). In such an embodiment, a substantial volume of a first component of the composite fracturing fluid may be emitted from the manipulatable fracturing tool 190. The first component of the composite fracturing fluid will flow into the surrounding wellbore 114 (as shown by flow arrow 22 of FIG. 5C) where it will mix with a second component of the composite fracturing fluid (as shown by flow arrow 24) to form the composite fracturing fluid (as shown by flow arrow 23). As the components of the fracturing fluid continue to be pumped downhole, the pressure increases and fracturing initiated.

Downhole mixing of the fracturing fluid components provides efficient and effective turbulent dispersion of the components to form the composite fracturing fluid. The mixed composite fracturing fluid is then introduced into the formation zone 2, 4, 6, 8, 10, or 12. Fracture initiation is established whereupon the formation 102 fails mechanically and one or more fractures form and/or are extended into the formation zone 2, 4, 6, 8, 10, or 12. As the fracture is initiated, the composite fracturing fluid flows into the fracture. Often, fracturing is initiated by pumping a "pad" stage comprising a low proppant-concentration, low viscosity fracturing fluid. As the fracture is formed, it may be desirable to increase the concentration of proppant within the composite fracturing fluid. Thus, in accordance with the present embodiments, the relative amount of concentrated proppant laden slurry provided for mixing may be increased so as to effectuate an increase in the viscosity of the composite fracturing fluid and to increase the concentration of proppant within the composite fracturing fluid. The proppant material may be deposited within the fractures formed within the formation zone 2, 4, 6, 8, 10, or 12 so as to hold open the fracture and provide for the increased recovery of hydrocarbons from the formation 102.

Where the manipulatable fracturing tool 190 has been configured to perform a given operation and that operation has been completed with respect to a given formation zone, it may be desirable to configure the manipulatable fracturing tool 190 to perform another operation within the same wellbore and without removing the manipulatable fracturing tool 190 from the wellbore 114. For example, configuring the manipulatable fracturing tool 190 may comprise altering the path of fluid flowing through or emitted from the manipulatable fracturing tool 190. Referring to FIG. 7A, in an embodiment, configuring the manipulatable fracturing tool 190 to emit fluid therefrom may comprise providing at least one flowpath between the first flowbore 128 of the first tubing member 126, the flowbore of the casing 120, or both and the wellbore 114. In an embodiment configuring the manipulatable fracturing tool 190 to emit fluid therefrom may comprise providing at least one flowpath between the first flowbore 128 of the first tubing member 126, the annular space between the first tubing member 126 and the casing 120, or both and the wellbore 114. Configuring the manipulatable fracturing tool 190 may again be accomplished by any one or more of opening a port or aperture 199, closing a port or aperture 199, providing and/or restricting a flowpath through the first flowbore 128 of the manipulatable fracturing tool 190, providing and/or restricting a flowpath through the second flowbore 228 of the manipulatable fracturing tool 190, or combinations thereof.

In an embodiment, configuring the manipulatable fracturing tool 190 may comprise engaging and/or disengaging an obturating member 180 with a seat 182 of the manipulatable fracturing tool 190. For example, the seat 182 may be associated with a sliding sleeve 190A that is (i) actuated open by engaging the obturating member 180 with a seat 182 and pressuring up on the flowbore to expose one or more ports or apertures 199 and (ii) actuated closed by pressuring down on the flowbore and allowing the sliding sleeve 190A to return to a biased closed position (e.g., spring biased). In an embodiment, removing the obturating member 180 may be accomplished by reverse-flowing a fluid such that the obturating member 180 disengages the seat 182, returns to the surface 104, and is removed from the axial flowbore 128 of the first tubing member 126. Such may open or otherwise provide a high-volume flowpath out of the end of the end of the manipulatable fracturing tool 190 (e.g., the lower or downhole end of the tool) as such an opening may be provided to allow the reverse-flowing of fluid. In an alternative embodiment, removal of the obturating member 180 may be accomplished by increasing the pressure against the obturating member 180 such that the obturating member 180 is disintegrated or is forced beyond or through the seat 182, which also may open or otherwise provide a high-volume flowpath through the manipulatable fracturing tool 190. Still other embodiments concerning removal of the obturating member 180 may comprise drilling through the obturating member 180 to remove the obturating member 180 or employing a dissolvable obturating member 180 designed to dissolve/disintegrate due to the passage of a set amount of time or due to designated changes in the obturating member's 180 environment (e.g., changes in pressure, temperature, or other wellbore conditions). Removal of the obturating member 180 will allow the flow of fluids through the axial flowbore 128 of the first tubing member 126 to be reestablished (e.g., a high-volume flowpath). In an embodiment, removing the obturating member 180 may cause no change in the position of the ports or apertures 199. In an alternative embodiment, removing the obturating member 180 may cause some or all of the ports or apertures 199 to be shifted open (e.g., via a sliding sleeve 190A or other manipulatable door or window; alternatively, via movement of a biased member or sleeve). In still another embodiment, removing the obturating member 180 may cause some or all of the ports or apertures 199 to be shifted closed.

Figure 6:
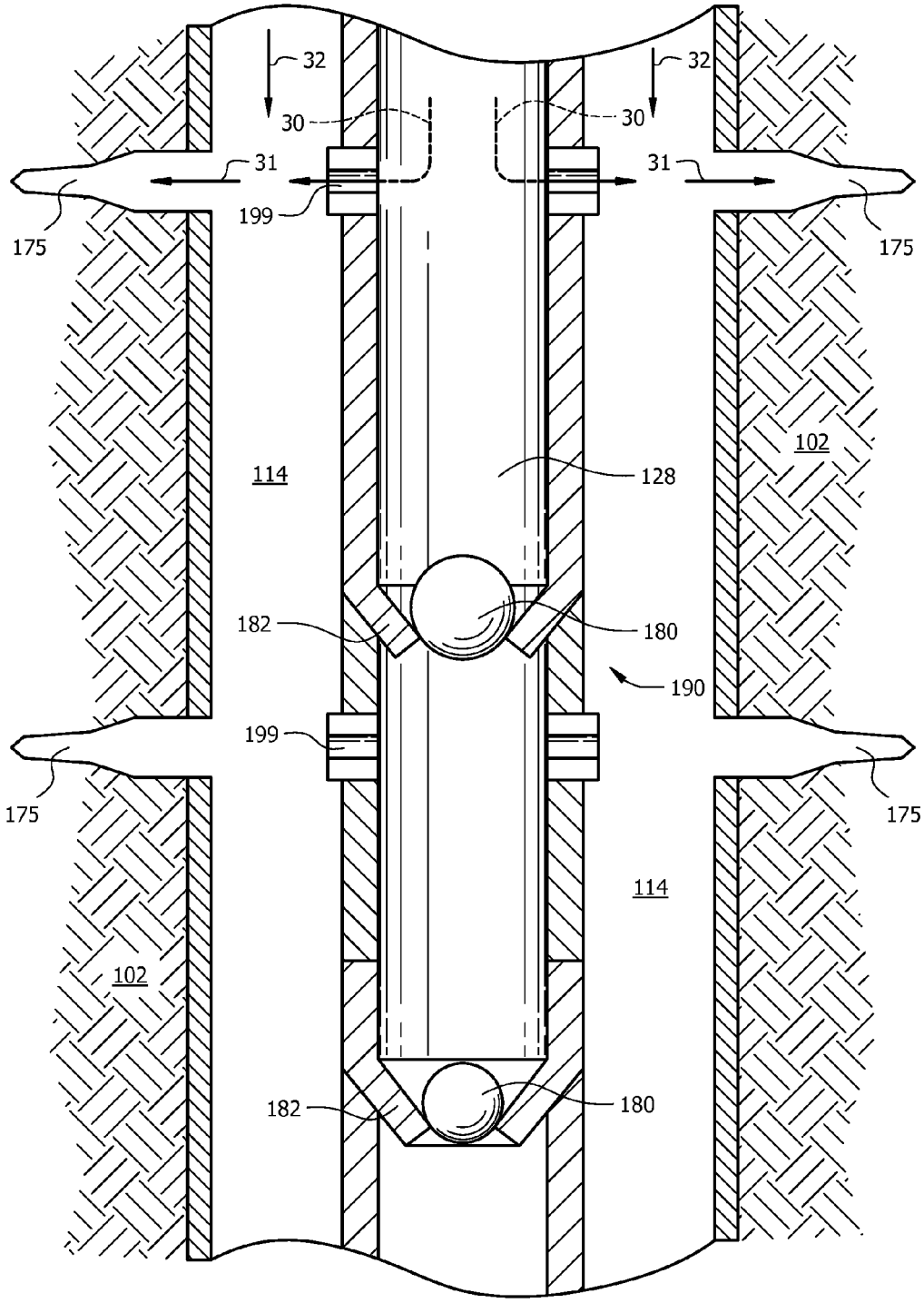
FIG. 6 is a cutaway view of a manipulatable fracturing tool depicting multiple obturating members engaging multiple seats and a fluid being emitted from some of the ports or apertures.

In still another embodiment as depicted in FIG. 6, the manipulatable fracturing tool 190 may be configured by the introduction of a second obturating member 180 having a larger diameter than the first obturating member 180 which engages a second seat comprised within the manipulatable fracturing tool 190. In such an embodiment, the second seat may be positioned above the first seat and configured such that the first obturating member 180 will not engage the second seat. The second seat may be operably coupled such that when the second obturating member 180 engages the second seat, the position of the ports or apertures 199 may be shifted from opened to closed or closed to open (e.g., via a sliding sleeve). The obturating member may cause a flow of a first fluid component to be emitted from a port or aperture 199 of the manipulatable fracturing tool 190 (shown by flow arrow 30). The first fluid component may mix with a second fluid component (shown by flow arrow 32) in the wellbore proximate to the formation 102 to form a composite fluid (shown by flow arrow 31) which will enter the formation 102.

EXAMPLE 1

Referring to FIGS. 3 and 4, in an embodiment, the manipulatable fracturing tool 190 comprises one or more hydrajetting tools or heads disposed at the end of work string 112 (e.g., coiled tubing). The work string is run into a wellbore 114 that may be cased, lined, partially cased, partially lined, or openhole. Where present, the casing 120 or liner may be permanent, retrievable, or retrievable/resettable, as is necessary. The wellbore 114 may be vertical, horizontal, or both (e.g., vertical wellbore with one or more horizontal or lateral side bores). The manipulatable fracturing tool 190 is run into the wellbore 114 to the deepest interval or zone to be treated (e.g., perforated and/or fractured).

Where desirable, a formation zone 2, 4, 6, 8, 10, or 12 being serviced may be isolated from any adjacent formation zone 2, 4, 6, 8, 10, or 12 (i.e., zonal isolation), for example by a packer or plug such as a mechanical packer or sand plug. In an embodiment, one or more packers may be utilized in conjunction with the disclosed methods, systems, and apparatuses to achieve zonal isolation. For example, in an embodiment one or more suitable packers may be placed within the wellbore. In an embodiment, the packer may comprise a Swellpacker™ commercially available from Halliburton Energy Services. In an additional or alternative embodiment, the function of the packer may be achieved via the setting of one or more sand plugs or highly viscous gel plugs.

In an exemplary embodiment of a method, a packer is positioned within the wellbore 114 downhole from the formation zone 2, 4, 6, 8, 10, or 12 which is to be serviced and the manipulatable fracturing tool 190 is positioned proximate or substantially adjacent to the formation zone 2, 4, 6, 8, 10, or 12 to be serviced. In an embodiment shown by FIG. 4D, the packer 160 may be attached to the manipulatable fracturing tool 190. Methods of isolating stimulated formation zones are described in greater detail in U.S. Pat. No. 7,225,869 to Willet et al., which is incorporated in its entirety herein by reference. In an embodiment where a packer is utilized, the packer may be set prior to introducing the manipulatable fracturing tool 190 into the wellbore 114.

The manipulatable fracturing tool 190 is actuated or manipulated (e.g., via a ball drop as described in more detail herein) such that the manipulatable fracturing tool 190 is configured for hydrajetting or perforating operations. In an embodiment, an obturating member 180 (e.g., ball) is used to manipulate the manipulatable fracturing tool 190 (e.g., hydrajetting tool). The tool may be manipulated via a ball as discussed herein with reference to any one of FIGS. 4A, 4B, 4C, and 4D. For example, referring to FIG. 4A, the ball is forward-circulated down the coiled tubing such that the ball engages a seat 182 disposed within the manipulatable fracturing tool 190. When the ball engages the seat 182, the ball restricts the flow of fluids such that fluids within the first flowbore 128 of the manipulatable fracturing tool 190 cannot move beyond the ball. The pressure against the ball is increased, causing ports or apertures 199 operably coupled to the seat 182 to be opened. These ports or apertures 199 may be fitted with hydrajetting or perforating nozzles 199. Thus, upon opening the ports or apertures, the manipulatable fracturing tool 190 is configured to emit a high-pressure stream of fluid therefrom via the ports or apertures 199 fitted with nozzles, that is, as a hydrajetting or perforating tool.

With the manipulatable fracturing tool 190 configured as a hydrajetting tool, perforations are cut into the wellbore 114, adjacent formation, and, where present, casing 120 by flowing fluid through the tool. Fluid (e.g., cut-sand) to be utilized in the perforating operation is forward circulated following the obturating member via a first flowpath (e.g., the first flowbore 128) of the wellbore servicing apparatus 100. Because the ball obstructs the flow of fluid through the first flowbore 128 of the manipulatable fracturing tool 190, the perforating/hydrajetting nozzles comprise the only available flowpaths, thus allowing for high-pressure perforating and/or fracture initiation operations. Thus, in this instance, the manipulatable fracturing tool 190 is configured as a perforating or hydrajetting tool. Perforations are then cut in the liner, casing, formation, or combinations thereof.

The ports or apertures 199 of the manipulatable fracturing tool 190 which are open when configured as a hydrajetting tool may be fitted with nozzles such that the fluid emitted therefrom will be emitted at a relatively high pressure and low volume.

Following perforating/hydrajetting operations, the success of a perforating operation and/or fracture initiation may be confirmed by pumping into the tubing, the annular space about the tubing, or both, thereby ensuring fluid communication with the perforations and thus, fracture initiation. Alternatively, in an embodiment, a volume of acid may be pumped so as to assist in fracture initiation.

Following perforating operations, the manipulatable fracturing tool 190 is reconfigured such that it no longer functions as a perforating or hydrajetting tool. In this embodiment, configuring the manipulatable fracturing tool 190 comprises reverse circulating the obturating member 180 and, if so-desired, any perforating or fracture initiation fluid remaining within the wellbore servicing apparatus 100. Reverse circulating the obturating member 180 (as shown by flow arrow 11 in FIG. 4B), allows for removal of the obturating member 180 from the wellbore servicing apparatus 100. Removing the obturating member 180 allows for the passage of a high volume of fluid at a relatively low pressure from the manipulatable fracturing tool 190 via the first flowbore 128 and/or other ports or apertures 199 (e.g., ports or apertures 199 of greater size and/or allowing higher flow volume than the perforating ports/nozzles/jets) of the manipulatable fracturing tool 190 and into the wellbore 114 proximate to the formation zone 2, 4, 6, 8, 10, or 12.

Upon reversing out the obturating member 180, the manipulatable fracturing tool 190 ceases to be configured as a hydrajetting or perforating tool. In embodiments where a packer is utilized, the obturating member 180 may be reverse-circulated out prior to, subsequent to, or without unsetting the packer. By reverse-circulating out the ball, a flowpath suitable for the emission of high-volume, relatively low-pressure fluids out of the end (e.g., the lower, downhole end) of the manipulatable fracturing tool 190 is thereby provided.

Once the manipulatable fracturing tool 190 has been configured to allow fluid communication between the manipulatable fracturing tool 190 and an area proximate to the formation zone 2, 4, 6, 8, 10, or 12, high volume fracturing/fracture extension operations may commence. As explained above, a first component of the fracturing fluid may be pumped via a first flowpath (as shown by flow arrow 12 of FIGS. 4C and 4D) and second component of the fracturing fluid may be pumped via a second flowpath (as shown flow arrow 13 of FIGS. 4C and 4D). Here, the first component of the fracturing fluid comprises a concentrated proppant laden slurry and the second component of the fracturing fluid comprises a non-abrasive fluid. The concentrated proppant laden slurry is pumped via the first flowpath, here, the axial flowbore (i.e., the first axial flowbore 128) of the jointed or coiled tubing (i.e., the first tubing member 126). The concentrated proppant laden slurry flows through the axial flowbore of the manipulatable fracturing tool 190 and into the wellbore 114 and is emitted from the manipulatable fracturing tool 190 (e.g., via the downhole end or other high volume window or opening, again shown by flow arrow 12 in FIGS. 4C and 4D). The second component of the fracturing fluid comprises a non-abrasive diluent (e.g., water). The non-abrasive diluent is pumped downhole via the second flowpath (e.g., in this embodiment, the annular space between the jointed or coiled tubing (shown as 126) and the casing 120 (shown by flow arrow 13). Alternatively, where the wellbore is uncased, the annulus between the jointed or coiled tubing (shown as 126) and the wellbore 114 (i.e., that part which is not occupied by the work string 112 or the wellbore servicing apparatus 100).

In the wellbore 114 proximate to the perforations which have previously been cut, the concentrated proppant laden slurry mixes with non-abrasive diluent to form the fracturing fluid that is pumped into the formation (as shown by flow arrow 14 of FIGS. 4C and 4D). Mixing the first component of the fracturing fluid with the second component of the proppant laden fluid in varying proportions will result in a proppant laden solution of varying proppant concentrations, viscosities, and thicknesses. Thus, by varying the proportions in which the first and second components of the fracturing fluid are mixed downhole, various concentrations and the slurry thicknesses may be achieved. As such, the composition of the fracturing fluid may be adjusted in real-time as by altering the flow rate and/or pressure with which either the first component or the second component is introduced.

Mixing of the fracturing fluid will occur in the area of the wellbore 114 proximate to the fractured formation zone 2, 4, 6, 8, 10, or 12 into which the fracturing fluid will be introduced (again, as shown by flow arrow 14 of FIGS. 4C and 4D). As the fractures form or are extended, the fracturing fluid moves from the wellbore 114 into the fractures. It may be desirable to vary the viscosity of the fracturing fluid or the concentration of the proppant with the fracturing fluid as the fracturing operation progresses. For example, as fracturing is initiated, it is common to pump a lower viscosity, lower proppant concentration fracturing fluid called a "padding" stage. The current methods and systems provide for real-time changes to the fracturing fluid viscosity and concentration as the fracturing operation progresses. Further, during the fracturing operation, the entire column of fluid within the first flowbore 128 need not be filled with concentrated proppant slurry. It is only necessary that a downhole portion of the first flowbore 128 be filled with the concentrated proppant slurry; the remainder of the first flowbore 128 may be filled with any suitable fluid. Thus, the instant methods alleviate some of the capital intensive nature of fracturing operations by necessitating a relatively small amount of proppant laden slurry and by making possible the later use of an unused portion of the concentrated proppant solution without needing to store and transport large volumes of treated fluid.

Upon completion of the fracturing (e.g., when a fracture of the desired length has been formed or extended), pumping is stopped and the zone having just been fractured is isolated from an upstream zone by placement of a sand plug or packer. In an embodiment, the placement of such a sand plug or packer may be accomplished by delivering a volume of sand (e.g., proppant) via the manipulatable fracturing tool 190. When operations (e.g., perforating and/or fracturing) at a given fracturing zone 2, 4, 6, 8, 10, or 12 have been completed the manipulatable fracturing tool 190 and wellbore servicing apparatus 100 may be employed to pump an isolation fluid (e.g., a sand plug) into the resulting fracture. In an embodiment, a concentrated sand slurry is pumped down the flowbore 128 of the tubing to form a sand plug, thereby isolating the zonal formations below the tool string. Alternatively, a mechanical plug (e.g., packer) may be placed (e.g., unset and reset) to isolate the zone having just been fractured. For example, a packer may be set prior to initiating the perforating operation. The packer may be un-set at some point following the conclusion of the fracturing operation and re-set at a different location in the wellbore.

The work string 112 and manipulatable fracturing tool 190 is then moved up-hole to the next formation zone 2, 4, 6, 8, or 10 and the process repeated until all formation zones 2, 4, 6, 8, 10, or 12 have been treated. The manipulatable fracturing tool 190 may be relocated proximate to another formation zone 2, 4, 6, 8, or 10, for which operations are desired. It is not necessary to remove the manipulatable fracturing tool 190 from the wellbore 114 at any point during normal operations, thus lessening the time and expenditures which might otherwise be associated which perforating and wellbore servicing operations. The process may then be repeated at every interval for which fracturing is desired.

At the conclusion of the fracturing operation, any of the concentrated proppant slurry remaining within the first axial flowbore 128 may be reverse circulated to the surface 104 and set aside for later use.

In an additional or alternative embodiment shown in FIGS. 4A, 4B, and 4C, the manipulatable fracturing tool 190 may comprise a "ported sub 191" comprising a length of tubular having one or more openings 191A. The ported sub 191 may be operable to achieve reversing-out of the obturating member 180, as is shown by flow arrow 11 in FIG. 4B. The ported sub 191 may also be operable in removing excess proppant (which may have landed on the packer) from within a wellbore 114 after the fracturing treatment so that the packer may be unset and moved. Upon removal of obturating member 180, the one or more openings 191 may provide a high volume flow path (e.g., a flow path providing for a higher volume of fluids and/or lower pressures than fluid flow through ports 199), whereby high volumes of concentrated fluid may be pumped down the flowbore 128, through openings 191 (and optionally additionally/partially through ports 199), and into the wellbore adjacent perforations 175. Such concentrated fluid may mix with a diluent fluid pumped down the annulus 176, and thereby form a servicing fluid (e.g., fracturing fluid) that may enter perforations 175 and initiate and/or extend fractures into the formation, for example to deposit proppant therein.

EXAMPLE 2

Figure 7B:
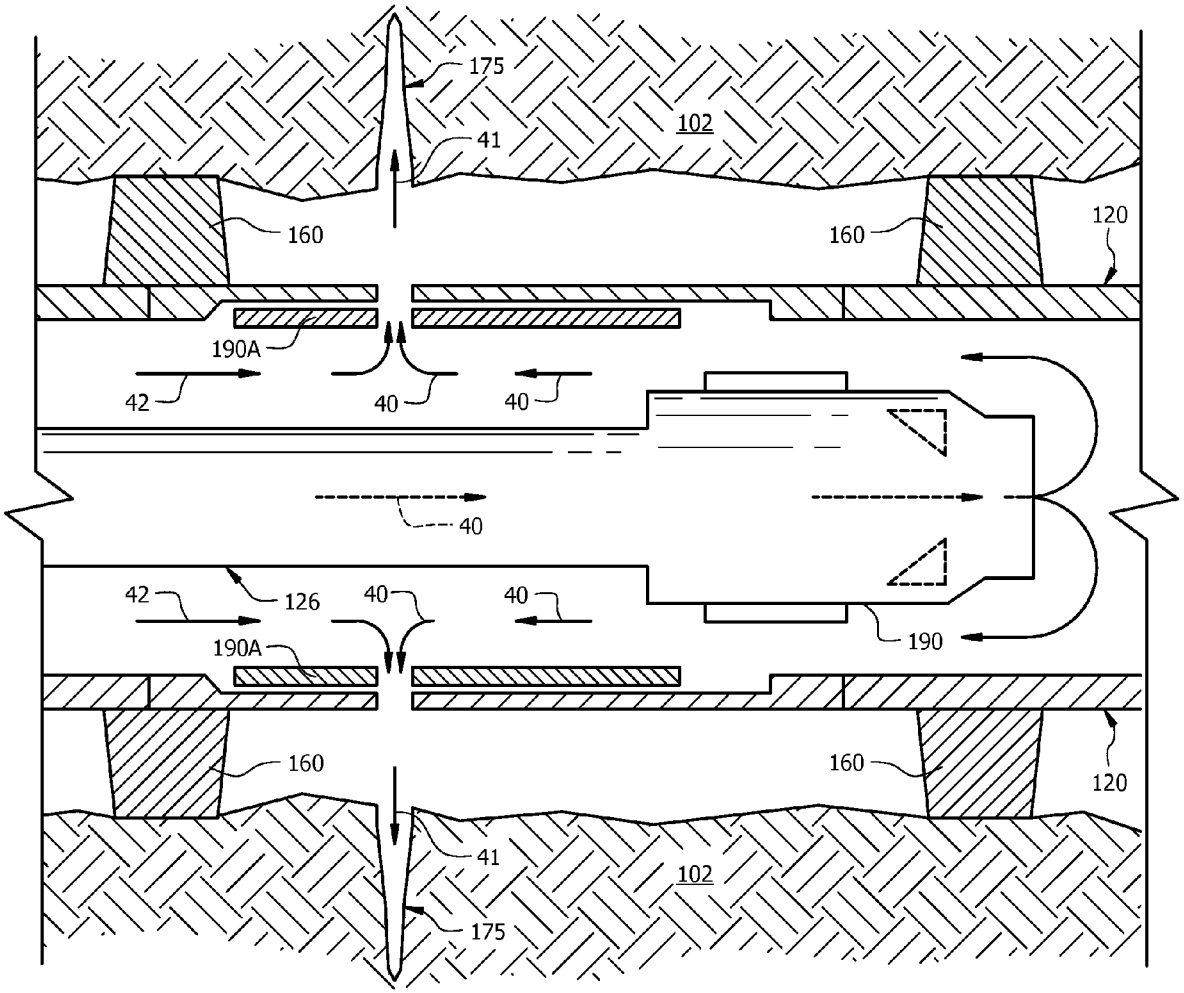
FIG. 7B a side view of a manipulatable fracturing tool having a sliding sleeve depicting a flow of fluid being emitted the manipulatable fracturing tool, mixing with a second fluid to form a composite fluid, and entering the formation.

Referring to FIGS. 2, 7A, and 7B, in an embodiment, the manipulatable fracturing tool 190 comprises one or more stimulation sleeves disposed within the casing 120. The casing 120 may be run into the wellbore 114 such that the stimulation sleeves disposed along the casing 120 will be located substantially adjacent to or aligned with the intervals or zones (e.g., zones 2, 4, 6, 8, 10, or 12) to be treated (e.g., fractured).

A plurality of stimulation sleeve assemblies 192 may be integrated within the casing, and isolation devices (e.g., packers such as mechanical or swellable packers) are positioned between each stimulation sleeve to form stimulation zones, for example as shown by the plurality of manipulatable fracturing tools 190 in FIG. 1 and by the packers 160 of FIG. 7B. The stimulation sleeve assembly is run into the wellbore 114 and aligned with the intervals or zones (e.g., zones 2, 4, 6, 8, 10, or 12) to be treated (e.g., fractured). Each stimulation sleeve assembly 192 may comprise a sliding sleeve 190A comprising one or more ports of the sliding sleeve 199A. By moving the sliding sleeve 190A relative to the casing 120, the ports of the sliding sleeve 199A may be selectively aligned with or misaligned with the ports or apertures 199. When the ports 199A and 199 are aligned, a fluid flowpath through the aligned ports 199 and 199A to the proximate formation zone 2, 4, 6, 8, 10, or 12 will be provided; when misaligned, a fluid flowpath to the proximate formation zone 2, 4, 6, 8, 10, or 12 will be restricted. An additional flow conduit (e.g., coiled or jointed tubing, which in some embodiments may have a mechanical shifting tool 300 attached thereto) may be run into the casing 120.

Referring again to FIG. 7A, a mechanical shifting tool 300, which may be coupled to the downhole end of a first tubing member 126 (e.g., coiled tubing), is inserted within the casing 120 and is positioned proximate to the stimulation sleeve assembly 192 to be actuated (e.g., that which is proximate or adjacent to a formation zone 2, 4, 6, 8, 10, or 12 for which servicing operations are desired). A ball 180 (i.e., an obturating member) is forward-circulated down the first tubing member 126 until the ball engages a ball seat 182 within the mechanical shifting tool 300. After the ball has reached the seat 182, an increase in the pressure across the mechanical shifting tool 300 will actuate the mechanical shifting tool 300, causing the mechanical shifting tool 300 to engage the sliding sleeve 190A of the stimulation sleeve assembly 192 to which the mechanical shifting tool 300 is proximate (i.e., "lugs" of the mechanical shifting tool 300 will extend, thus engaging the sliding sleeve 190A). The mechanical shifting tool 300 may then be used to align or misalign the ports or apertures 199 of the stimulation assembly 192 and the ports of the sliding sleeve 199A, thereby providing or restricting a flowpath to the adjacent formation zone 2, 4, 6, 8, 10, or 12.

With the mechanical shifting tool 300 engaging the sliding sleeve 190A, the first tubing member 126 will be operatively coupled to the mechanically shifted sleeve. When the mechanical shifting tool 300 is so-coupled to the sliding sleeve 190A, movement of the first tubing member 126 relative to the casing 120 (within which the sliding sleeve 190A is disposed) will move the sliding sleeve 190A. By moving the sliding sleeve 190A, the position of the ports of the sliding sleeve 199A may be altered relative to the ports or apertures 199 (i.e., the ports of the sliding sleeve may be moved so as to align with or not align with the ports or apertures 199A). Thus, with the ports of the sliding sleeve 199A and the ports or apertures 199 aligned, the formation zone 2, 4, 6, 8, 10, or 12 is exposed. The obturating member 180 may then be reverse circulated and removed.

In some embodiments, one or more perforations 175 or fracture initiations may be formed in the adjacent formation zone 2, 4, 6, 8, 10, or 12. To form such a perforation, concentrated perforating fluid (e.g., cut-sand) is pumped down the first flowpath, in this embodiment, the axial flowbore 128. The concentrated perforating fluid may exit the tool via the aligned (i.e., open) ports 199 and 199A. In an embodiment, back pressure is held on fluid contained within the annular space between the casing 120 and the first tubing member 126 such that the concentrated fluid is emitted from the ports in a concentrated form. Alternatively, a diluent (e.g., water or other less abrasive fluid) may be pumped down the annulus between the casing 120 and the first tubing member 126. The concentrated perforating fluid will mix with the non-abrasive fluid down-hole, proximate to the formation zone 2, 4, 6, 8, 10, or 12 to be perforated and be emitted from the tool via the aligned (i.e., open) ports 199 and 199A. The ports from which the fluid is emitted 199 or 199A may configured such that the fluid will be emitted at a pressure sufficient to degrade the proximate formation zone 2, 4, 6, 8, 10, or 12. For example, the ports 199 or 199A may be fitted with nozzles (e.g., perforating or hydrajetting nozzles).

In an embodiment, the nozzles may be erodible such that as fluid is emitted from the nozzles, the nozzles will be eroded away. Thus, as the nozzles are eroded away, the aligned ports 199 and 199A will be operable to deliver a relatively higher volume of fluid and/or at a pressure less than might be necessary for perforating (e.g., as might be desirable in subsequent fracturing operations). In other words, as the nozzle erodes, fluid exiting the ports transitions from perforating and/or initiating fractures in the formation to expanding and/or propagating fractures in the formation.

In another embodiment, following the completion of perforating operations the obturating member 180 (i.e., a ball) may be reintroduced into the first tubing member 126 such that the obturating member 180 re-engages the seat 182 and again actuates the mechanical shifting tool 300, thereby causing the mechanical shifting tool 300 to engage the sliding sleeve 190A. Again, the mechanical shifting tool 300 will be operably coupled to the sliding sleeve 190A such that another combination of ports of the sliding sleeve 199A and ports or apertures 199 may be aligned, thereby providing delivery of a relatively higher volume of fluid and/or at a pressure less than might be necessary for perforating (e.g., as might be desirable in subsequent fracturing operations). In other words, the sliding sleeve 190A may be repositioned such that additional and/or larger ports, openings, or windows are provided to allow for a higher volume of fluid to be pumped into the formation, thereby initiating, expanding, and/or propagating fractures in the formation.

Figure 7C:
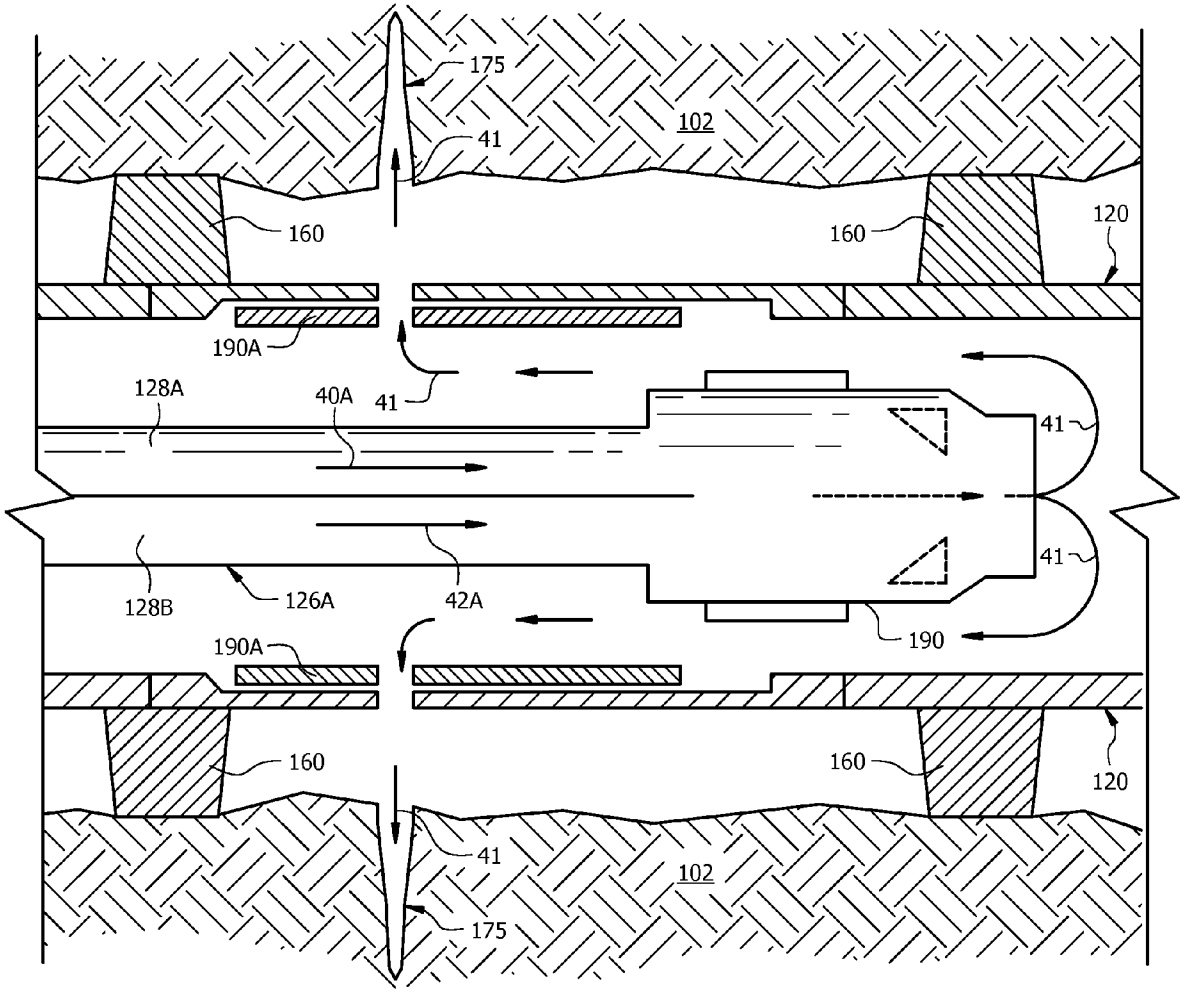
FIG. 7C is a side view of a manipulatable fracturing tool having a sliding sleeve depicting a first fluid and a second fluid being introduced proximate to a formation via a divided flow conduit, mixing to form a composite fluid, and entering the formation.

To fracture the formation, a concentrated proppant slurry is pumped down the flowbore 128 of the additional flow conduit (e.g., inside the coiled tubing, as shown by flow arrow 40 of FIG. 7B) simultaneous with pumping a diluent fluid (e.g., water, as shown by flow arrow 42 of FIG. 7B) down the annulus between the additional flow conduit (e.g., coiled tubing 126) and the casing 120. The concentrated proppant slurry exits the coiled tubing (e.g., via flow ports in the mechanical shifting tool 300) and mixes with the diluent fluid proximate the perforations and formation zone 2, 4, 6, 8, 10, or 12 to be fractured. In an alternative embodiment illustrated by FIG. 7C, a concentrated proppant slurry is pumped down a first flowbore 128A of a divided flow conduit (e.g., coiled tubing 126A), as shown by flow arrow 40A while simultaneously pumping a diluent fluid (e.g., water) down a second flowbore 128B of the divided flow conduit, as shown by flow arrow 42A. In such an embodiment, the concentrated proppant slurry and the diluent mix while exiting the divided flow conduit 126A proximate the perforations and formation zone 2, 4, 6, 8, 10, or 12 to be fractured. The mixed fracturing fluid passes through the sleeve (which may have been further manipulated to open additional or alternative flow ports to increase flow rates there through, e.g., high volume ports) and is forced into the formation 102 via continued pumping at pressures sufficient to form and extend fractures in the formation 102. As the fractures form or is extended, the fracturing fluid moves from the wellbore 114 into the fractures formed in the formation 102 (as shown by flow arrow 41 of FIGS. 7B and 7C). The viscosity or proppant-concentration of the composite fracturing fluid may be varied as the fracturing operation progresses.

Upon completion of the fracturing, pumping is stopped and the formation zone 2, 4, 6, 8, 10, or 12 having just been fractured is isolated from an upstream zone by closing the stimulation sleeve. After a first formation zone 2, 4, 6, 8, 10, or 12 has been fractured, the obturating member 180 (i.e., a ball) may be reintroduced into the first tubing member 126 such that the obturating member 180 re-engages the seat 182 and again actuates the mechanical shifting tool 300, thereby causing the mechanical shifting tool 300 to engage the sliding sleeve 190A. Again, with the mechanical shifting tool 300 will be operably coupled to the sliding sleeve 190A such that the ports of the sliding sleeve 199A may be misaligned from the ports or apertures 199 (e.g., closed). The next zone uphole may then be treated (for example, by moving the coiled tubing upward along with the mechanical shifting tool and opening the next stimulation sleeve) and the process repeated until all zones have been treated. The first tubing member 126 to which the mechanical shifting tool 300 is connected may be repositioned such that the mechanical shifting tool 300 is then proximate to a second sliding sleeve 190A and the process repeated.

EXAMPLE 3

Referring to FIGS. 1, 5A, 5B, and 5C, a ball may be used to manipulate the stimulation sleeve, referred to herein as a ball drop sleeve. In an embodiment, the ball drop sleeve is integral with first tubing member 126, which may comprise coiled tubing, jointed tubing, or casing 120. The ball drop sleeves are positioned proximate to the formation zones 2, 4, 6, 8, 10, or 12 for which servicing is desired.

Next, a ball (i.e., an obturating member) 180 is forward-circulated down the first tubing member 126 until the ball 180 engages a ball seat 182 within the ball drop sleeve 193. When the ball 180 engages the seat 182 with sufficient force (i.e., the pressure against the ball 180 is sufficient), the sliding sleeve 190A will shift such that the ports of the sliding sleeve 199A will align with the ports or apertures 199A and fluid will flow through the aligned ports 199 and 199A. In an embodiment, the sliding sleeve may be held in a closed position (i.e., with the ports 199 and 199A misaligned, as shown by FIG. 5B) by a spring or similar mechanism (i.e., biased). Where the ports 199 and 199A are misaligned and the ball 180 does not obstruct passage, fluid will flow through the axial flowbore 128 of manipulatable fracturing tool (as shown by flow arrow 21 in FIG. 5B). When the ball 180 is introduced and engages the seat 182, the force applied against the ball 180 engaging the seat 182 must be sufficient to overcome the force exerted in the opposite direction by the biasing mechanism (e.g., spring) for the ports 199 and 199A to align.

In an alternative embodiment, the ball 180 engaging ball seat 182 actuates a sliding sleeve 190A to align and/or expose one or more jetting nozzles or flow ports 199 or 199A. In an embodiment, the jetting nozzles or flow ports 199 or 199A may be fitted with erodible nozzles. A low-volume, high-pressure fluid may then be emitted from the ports 199 or 199A so as to perforate or hydrajet (as shown by flow arrow 20 of FIG. 5A) and form perforations 175 and/or initiate/propagate one or more fractures in the formation. As the perforating or hydrajetting operation is carried out, the nozzles may be eroded away, allowing for a higher-volume, lower-pressure fluid to be emitted from the ports 199 or 199A.

Next, a concentrated proppant laden slurry is pumped down the first flowpath (e.g., the axial flowbore 128) while a non-abrasive diluent (e.g., water) is pumped down the second flowpath (e.g., the annular space 176 not occupied by the wellbore serving apparatus 100 or the work string 112). The concentrated proppant slurry (shown by flow arrow 22 of FIG. 5C) will mix with the non-abrasive fluid (shown by flow arrow 24) down-hole, proximate to the formation zone 2, 4, 6, 8, 10, or 12 of fracture. The mixed, composite fracturing fluid is introduced into the formation 102 (shown by flow arrow 23). The fracturing fluid components are pumped downhole, thus increasing the pressure until the fracture initiation pressure is reached and a fracture either begins to form or is extended. As the fractures forms or is extended, the fracturing fluid moves from the wellbore 114 into the fractures. The viscosity or proppant-concentration of the composite fracturing fluid may be varied as the fracturing operation progresses. After a first formation zone 2, 4, 6, 8, 10, or 12 has been fractured, the ball 180 may or may not be removed.

Where multiple ball drop sleeves 193 disposed within multiple manipulatable fracturing tools 190 have been introduced into the wellbore 114 and positioned proximate to formation zones 2, 4, 6, 8, 10, or 12 to be fractured, operations may now begin as to the second most downhole formation zone 2, 4, 6, 8, 10, or 12. For example as shown in FIG. 6, the various ball drop sleeves 193 may have seats 182 of differing sizes. Particularly, the downhole-most of the ball drop sleeves 193 will be configured to engage to smallest diameter ball 180 while those ball drop sleeves 193 located upwardly therefrom will engage only progressively larger balls 180. That is, the deepest ball drop sleeve 193 will engage the smallest diameter ball 180; the second deepest ball drop sleeve 193 will engage the second smallest diameter ball 180 but not the smallest ball, and so on. Thus, a ball 180 of a given diameter introduced into the tubing member and pumped downhole will pass through and beyond all ball drop sleeves 193 which are shallower than the ball drop sleeve 193 which that ball 180 is meant to engage.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4., etc.; greater than 0.10 includes 0.11, 0.12, 0.13., etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference in the Description of Related Art is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method of servicing a wellbore comprising;

inserting a first tubing member having a flowbore into the wellbore having disposed therein a casing string, wherein a manipulatable fracturing tool, or a component thereof, is coupled to the first tubing member and wherein the manipulatable fracturing tool comprises a first one or more ports and a second one or more ports configurable to alter a flow of fluid through the minipulable fracturing tool;

positioning the manipulatable fracturing tool within the casing string within the wellbore proximate to a formation zone to be serviced;

introducing an obturating member into the first tubing member;

forward-circulating the obturating member to engage an obturating structure within the manipultable fracturing tool and thereby manipulate the manipulatable fracturing tool such that there is fluid communication between the flowbore of the first tubing member and the wellbore via the first one or more ports and such that there is not fluid communication between the flowbore of the first tubing member and the wellbore via the second one or more ports;

emitting a first fluid from the first one or more ports;

reverse circulating the obturating member to disengage the obturating member from the obturating structure and thereby further manipulate the manipulatable fracturing tool such that there is fluid communication between the flowbore of the first tubing member and the wellbore via the first one or more ports and the second one or more ports;

introducing at least a portion of a first component of a composite fluid into the wellbore at a first rate via the flowbore of the first tubing member, the first one or more ports, and the second one or more ports;

introducing a second component of the composite fluid into the wellbore at a second rate via an annular space formed by the first tubing member and the wellbore;

mixing the first component of the composite fluid with the second component of the composite fluid within the welibort; and introducing the comrposite fluid into the fonnation zone.

2. The method of claim 1,wherein at least one of the first one or more ports of the manipulatable fracturing tool comprises a hydrajetting nozzle, wherein the engagement of the obturating mi-mber operates to direct fluid flow through the hvdraletting nozzle.

3. The method claim 2 wherein the fluid flow through the hydraletting nozzle is sufficient to depide a liner, a casing, the formation zone, or combinations thereof.

4. The method of claim 3, wherein the fluid flow through the hydrajetting nozzle is sufficient to initiate a fracture in the formation zone.

5. The method of claim 2, wherein disengaging the obturating member operates to provide a higher volume flowpath through the: second one or more ports in comparison to the flowpatia through the first one or more ports for emission of fluid from the tool into the wellbore.

6. The method of claim 5 wherein the fluid emitted from the tool is utilized to initiate a fracture or extend a fracture in the formation zone.

7. The method of claim 1, wherein the first component of the composite fluid comprises a concentrated acid component, wherein the second component of the composite fluid comprises a diluent, and wherein the composite fluid comprises an acidizing solution that is formed within the wellbore proximate to the formation zone to effectuate an acidizing operation.

8. The method of claim 1, wherein the first component of the composite fluid comprises a concentrated isolation fluid component, wherein the second component of the composite fluid comprises a diluent, and wherein the composite fluid comprises an isolation fluid that is formed within the wellbore proximate to the formation zone to effectuate an isolation operation.

9. The method of claim 1, wherein the first component of the composite fluid comprises a concentrated proppant-laden fluid, wherein the second component of the composite fluid comprises a diluent, and wherein the composite fluid comprises a fracturing fluid that is formed within the wellbore proximate to the formation zone to effectuate a fracturing operation.

10. The method of claim 1, wherein the first one or more ports of the manipulatable fracturing tool comprise a higher pressure port in comparison to the second one or more ports, and wherein the second one or more ports of the manipulatable fracturing tool comprise a higher volume, port in comparison to the first one or more ports.

11. The wellbore servicing system of claim 1, wherein the manipulatable fracturing tool is transitionable while in the wellbore from a first configuration in which the fluid is communicated via the first one or more ports to degrade a liner, a casing, a formation zone, or combinations thereof to a second configuration in which the fluid is communicated via the first one of more ports and the second one or more ports to initiate or extend fractures in the formation zone.

12. The method of claim 10, wherein forward-circuating the obturatin member to engage an obturating structure operates to direct a fluid flow through the higher pressure port.

13. The method of claim 10, wherein reverse circulating the obturating member to disengage the obturating member from the obturating structure operates to allow a fluid flow through the higher volume port.

14. The wellbore servicing system of claim 1, wherein at least one of the first one or more ports is fitted with a nozzle.

15. The method of claim 1, further comprising varying a rate at which the first component of the composite fluid is introduced into me wellbore via the flowbore of the first tubing member, varying a rate at which the second component of the composite fluid is introduced into the wellbore via the annular space, or combinations thereof.

16. The method of claim 15, wherein varying the rate at which the first component of the composite fluid is introduced into the wellbore via the flowbore of the first tubing member, varying the rate at which the second component of the composite fluid is introduced into the wellbore via the annular space, or combinations thereof is effective to vary the concentration of an acid, a proppant a gel, an abrasive material within the composite fluid.

17. The method of claim 1, further comprising varying the concentration of an acid, a proppant, a gel, an abrasive material within the composite fluid without changing the composition of either the first component or the second component of the composite fluid.

18. The. method of claim 1, wherein the first tubing member comprises coiled tubing.

19. A method of servicing a wellbore comprising:

inserting a casing string having a flowbore into the wellbore, wherein a plurality of manipulatable fracturing tools are coupled to the casing string and wherein the manipulatable fracturing tools comprise one or more ports configured to alter a flow of fluid through the manipulatable fracturing tool;

positioning the manipulatable fracturing tools proximate to zones in a formation to be fractured;

inserting a first tubing member within the casing string, wherein a shifting tool is attached to the first tubing member, wherein the shifting tool further comprise:

a baffle plate;

an obturating member seat;

an indexing check valve;

or combinations thereof;

positioning the shifting tool proximate to at least one of the manipulatable fracturing tools;

actuting the shifting tool such that the actuation of the shifting tool engages the manipulatable fracturing tool such that the manipulatable fracturing tool may be manipulated to establish fluid communication between the flowbore of the first tubing member and the wellbore, wherein actuating the shifting tool comprises causing introducing an obturating member via the flowbore of the first tubing member to engage the baffle plate, the obturating member seat, the indexing check valve, or combination thereof, wherein the engagement of the obturating member actuates the shifting tool;

disengaging the obturating member from the shifting tool and removing the obturating member from the flowbore of the first tubing member;

after removing the obturating member, introducing a first component of a composite fluid into the wellboreore via the flowbore of the first tubing member at a first rate;

introducing a second component of the composite fluid into the wellbore via annular space formed by the first tubing member and the casing string at a second rate;

mixing the first component of the composite fluid with the second component of the composite fluid within the wellbore; and introducing the composite fluid into the formation, thereby causing a fracture to form or be extended within the formation.

20. The method of claim 19, wherein the first tubing member comprises an axial flowpath divided into two or more separate flowpaths.

21. The method of claim 19, further comprising isolating the zones in the formation.

22. The method of claim 21, wherein the zones in the formation are isolated via swellable packers disposed about the casing string between each of the plurality of manipulatable fracturing tools.

23. The method of claim 19, wherein the first tubing member comprises coiled tubing.

* * * * *